US010077602B2

(12) United States Patent
Rowley et al.

(10) Patent No.: US 10,077,602 B2
(45) Date of Patent: Sep. 18, 2018

(54) SECURITY AND ESCAPE APPARATUS FOR USE WITH A WINDOW

(71) Applicants: Dean Rowley, Bruxelles (CA); Bryan Devloo, Swan Lake (CA)

(72) Inventors: Dean Rowley, Bruxelles (CA); Bryan Devloo, Swan Lake (CA)

( * ) Notice: Subject to any disclaimer, the term of this patent is extended or adjusted under 35 U.S.C. 154(b) by 67 days.

(21) Appl. No.: 15/075,850

(22) Filed: Mar. 21, 2016

(65) Prior Publication Data

US 2016/0333639 A1 Nov. 17, 2016

Related U.S. Application Data

(60) Provisional application No. 62/159,698, filed on May 11, 2015.

(51) Int. Cl.

| | |
|---|---|
| ***E06C 9/10*** | (2006.01) |
| ***E06B 9/02*** | (2006.01) |
| ***E06B 9/01*** | (2006.01) |
| ***A62B 3/00*** | (2006.01) |
| ***E06B 9/06*** | (2006.01) |

(52) U.S. Cl.

CPC ..... *E06C 9/10* (2013.01); *A62B 3/00* (2013.01); *E06B 9/01* (2013.01); *E06B 9/02* (2013.01); *E06B 9/063* (2013.01); *E06B 9/0623* (2013.01)

(58) Field of Classification Search

CPC . E06B 9/02; E06B 9/06; E06B 9/0607; E06B 9/0615; E06B 9/0623; E06B 9/063; E06B 9/0676; E06B 9/0646; E06B 9/0653; E06B 9/0661; E06B 2009/002; E06B 9/00; E06B 9/01; A62B 3/00; E06C 9/00; E06C 9/02; E06C 9/06; E06C 9/08; E06C 9/085; E06C 9/10; E05C 19/003; E05B 65/1033

USPC ..... 49/50, 56

See application file for complete search history.

(56) References Cited

U.S. PATENT DOCUMENTS

| | | | | |
|---|---|---|---|---|
| 43,283 A * | 6/1864 | Ballentine | ..... | E06C 9/10 182/21 |
| 269,377 A * | 12/1882 | Bessier | ..... | E06C 9/10 182/21 |
| 573,165 A * | 12/1896 | Scherrer | ..... | E06C 9/10 182/21 |
| 1,072,024 A * | 9/1913 | Momo | ..... | E06C 9/14 182/157 |

(Continued)

*Primary Examiner* — Daniel P Cahn

(74) *Attorney, Agent, or Firm* — Kyle R. Satterthwaite; Ade & Company Inc.; Ryan W. Dupuis

(57) ABSTRACT

A security and escape apparatus for use with a window mounted in a wall at a position spaced above a support surface is disclosed. According to one aspect of the invention track members of a first bar section are S-shaped in cross-section so as to carry a second bar section thereon and thereby allowing the bar members of the bar sections to be uniform in length. According to another aspect a release mechanism comprises an abutting portion which is positioned beneath the bar sections to retain the sections across a window opening. The abutting portion is positioned horizontally outwardly of the bar sections such that the bar sections can extend to form a ladder beneath the window opening. According to another aspect the apparatus includes a window frame mounting arrangement cooperative with the obstructing position for resisting dismantling of the apparatus.

19 Claims, 16 Drawing Sheets

(56) References Cited

U.S. PATENT DOCUMENTS 2,195,291 A * 3/1940 Zukor ..... E06L 39/0623 109/38
2,924,862 A * 2/1960 Pellicore ..... E06B 9/01 292/203
3,259,207 A * 7/1966 Schoeffler ..... E06C 9/10 182/161
3,997,026 A * 12/1976 Riehlmann ..... E06C 1/125 182/18
4,476,957 A * 10/1984 Ory ..... E06O 9/10 182/195
4,638,596 A * 1/1987 Gallardo ..... E05B 65/1033 292/267
4,815,561 A * 3/1989 Ostrander ..... E06O 9/10 182/163
5,024,293 A * 6/1991 Yang ..... E06O 7/185 182/105
5,339,567 A * 8/1994 Pierpont ..... E06B 9/01 49/55
5,461,827 A * 10/1995 Lofton ..... E06B 9/02 49/55
5,603,183 A * 2/1997 Giovinazzi ..... E06B 9/02 49/55
5,740,628 A * 4/1998 Almond ..... E05C 19/003 49/141
5,875,870 A * 3/1999 Lee ..... A62B 5/00 182/70
5,893,235 A * 4/1999 Almond ..... E05C 19/003 182/93
5,893,431 A * 4/1999 Cranswick ..... E06C 9/08 182/70
6,276,430 B1 * 8/2001 Wu ..... E06L 39/0638 160/240
6,510,654 B1 * 1/2003 McCracken ..... E05B 65/1033 49/50
2004/0055218 A1 * 3/2004 Forsyth ..... E06B 9/02 49/54
2006/0130404 A1 * 6/2006 Lilly ..... E05B 47/0002 49/280

* cited by examiner

SECURITY AND ESCAPE APPARATUS FOR USE WITH A WINDOW

This application claims the benefit under 35 U.S.C. 119(e) of U.S. Provisional Application Ser. No. 62/159,698 filed May 11, 2015.

FIELD OF THE INVENTION

The present invention relates generally to a window security device for obstructing a window, and more particularly to a window security device which is positionable to form a ladder for exiting through the window.

BACKGROUND

A window presents an easy access point for an intruder wishing to enter a home. Typically, a basement window presents one of the easiest access point through a window into a home because of proximity of the basement window to the ground; however, windows on a main floor may also define preferred access points. As such, window security bars are available for obstructing the window for preventing passage of the intruder therethrough. In spite of the security afforded by these bars, one potential shortcoming of the traditional bar assembly that is fixedly installed across the window is that this assembly is likely to present a significant obstacle in exiting the home through the window in case of an emergency such as a fire, smoke, or presence of an intruder in the home. Typically, this obstacle is nearly impossible to overcome in a short period of time.

Furthermore, many windows are positioned in the wall such that the respective bottom sills of the windows are raised high above the floor. As such, the height of the window above the floor presents an additional obstacle to exiting the home through the window in case of the emergency.

Prior art window security devices have been developed so as to overcome the obstacles to exiting through the window as described hereinbefore. To accomplish this, each prior art device provides an assembly which is movable between a first position obstructing the window to a second position in which the assembly forms the ladder for exiting through the window. However, the prior art devices have several potential shortcomings. One potential shortcoming of devices employing a plurality of slidable sections which form the ladder in an extended position is that the length of the ladder rungs defined by horizontal members of the slidable sections decreases from a first section in closest relation to the window (relative to the second extended position) to subsequent sections thereunder. For windows which are relatively narrow, some subsequent sections may have horizontal members which are too narrow to be suited for use as ladder rungs.

Another potential shortcoming of the prior art window security devices is that the devices comprise release mechanisms which are difficult to activate quickly and which are difficult to return to a locked position from an unlocked position, for example in case of accidental deployment into the extended position.

A further potential shortcoming is that it may be possible to easily remove the prior art window security devices so that the intruder can overcome the obstruction presented by the security device and successfully enter the home.

The applicant presents a unique solution for window security bars which may overcome the potential shortcomings of the window security devices currently known to the public.

SUMMARY OF THE INVENTION

According to one aspect of the invention there is provided a combination of a window mounted in a wall at a position spaced above a support surface and a security and escape apparatus comprising:

the window having:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus having:

at least one bar section comprising a pair of upright track members spaced apart from one another and a plurality of bar members extending transversely between the pair of track members at longitudinally spaced positions along the track members;

a pair of main rails oriented upright and respectively mounted to each side jamb so as to be located horizontally outward of the window frame away from the wall;

the track members of a first one of the at least one bar section being mated to the main rails such that the first bar section is vertically slidable relative to the main rails in a longitudinal direction;

the at least one bar section being movable relative to the window frame in vertical sliding movement between a first obstructing position in which at least one of said at least one bar section is obstructing the egress opening and a second extended position in which each bar section is disposed below the egress opening so that the bar members define ladder rungs usable for exiting through the egress opening unobstructed by each bar section;

wherein the at least one bar section comprises two bar sections, a second one of the bar sections being mated to the first bar section so as to be vertically slidable relative to the first bar section;

wherein each track member of the first bar section comprises a pair of upright channels which are disposed horizontally side-by-side, a first one of the channels slidably receiving one of the main rails therein and a second one of the channels slidably receiving one of the track members of the second bar section therein such that at least one bar member of the first bar section and at least one bar member of the second bar section are equal in length between the track members of the respective bar section.

In the embodiment as described in more detail hereinafter, the shaping of the track members of the first bar section allows the length of the bar members of the second bar section to be equal to that of the first bar section so that the ladder rungs defined by the bar members may be sufficiently long for comfortably using the rungs for exiting through the window.

Preferably, each channel of each track member of the first bar section is generally U-shaped in cross-section. Preferably, each channel comprises a longitudinal channel opening, and the channel openings of the first and second channels face in opposing directions along the wall which are transverse to the longitudinal direction. It is preferred that the channel opening of the first channel is facing transversely outward away from the window frame and the open channel side of the second channel is facing transversely inward towards the second channel of the opposing track member.

In other words, it is preferred that each track member of the first bar section is generally S-shaped in cross-section such that each upright channel in the respective track member is generally U-shaped in cross-section.

Preferably, the length of the bar members is adjustable such that lateral spacing between the main rails is adjustable for fitting the window frame. In one instance, a plurality of telescoping members which are slidable relative to one another in telescoping configuration define at least one of the horizontal bar members. Typically, the plurality of telescoping members comprises two telescoping members, and a first one of the telescoping members, which is attached to one of the track members of the respective bar section, is received in a second one of the telescoping members that is received in an opposing one of the track members of the respective bar section.

Preferably, at least one bar section further includes an upright support member spanning between the bar members at a position intermediate the track members. The upright support member may provide additional support near a midpoint of the respective bar members to resist sag or bending thereof. Moreover, the upright support member may aid in obstructing the egress opening in the first obstructing position.

Preferably, each bar section spans across the egress opening in the first obstructing position. Preferably, the bar sections span across the egress opening in an overlapping arrangement in which each bar section is disposed horizontally adjacent to one another. The respective bar section is oriented upright. As such, a majority of each bar section is overlapped by another bar section in the first obstructing position. In other words, it is preferred that one bar section overlaps at least a majority of another one of the bar sections in the first obstructing position. The first obstructing position may also be termed 'first retracted position'.

Preferably, the two bar sections are positioned vertically adjacent one another in the second extended position so as to collectively form a ladder. In other words, each bar section defines a short ladder in the second extended position, and positioning of the bar sections side-by-side in a vertical direction allows one bar section to form a vertical extension of the short ladder defined by another bar section. Further alternatively expressed, one bar sections overlaps less than a majority of another one of the bar sections in the second extended position. The bar sections are positioned vertically adjacent to one another in the second extended position such that a majority of the bar members define individual ladder rungs in the second extended position. A topmost bar member of the second bar section is aligned in a horizontal plane (i.e., a plane parallel to the support surface) with a bottommost bar member of the first bar section so that the bottommost bar member and the topmost bar member of respective bar sections define a common ladder rung in the second extended position.

In one instance, the bar members of each of the two bar sections are longitudinally spaced along the respective pair of track members so that the bar members of the two bar sections that are intermediate a top one of the bar members and a bottom one of the bar members of each bar section are staggered relative to one another so as to form a grate in the first obstructing position. Staggering the bars as described may reduce weight of each bar section while functioning equally well for obstructing the egress opening as bar sections which have a uniform number of the bar members.

According to another aspect of the invention there is provided a combination of a window mounted in a wall at a position spaced above a support surface and a security and escape apparatus comprising:

the window having:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus having:

at least one bar section comprising a pair of upright track members spaced apart from one another and a plurality of bar members extending transversely between the pair of track members at longitudinally spaced positions along the track members;

a pair of main rails oriented upright and respectively mounted to each side jamb so as to be located horizontally outward of the window frame away from the wall;

the track members of a first one of the at least one bar section being mated to the main rails such that the first bar section is vertically slidable relative to the main rails in a longitudinal direction;

the at least one bar section being movable relative to the window frame in vertical sliding movement between a first obstructing position in which at least one of said at least one bar section is obstructing the egress opening and a second extended position in which each bar section is disposed below the egress opening so that the bar members define ladder rungs usable for exiting through the egress opening unobstructed by each bar section;

a release mechanism operatively coupled to the bar sections so as to be movable between a first locked position in which the release mechanism retains the at least one bar section in the first obstructing position and a second unlocked position in which the release mechanism frees the at least one bar section for moving into the second extended position;

the release mechanism comprising:

an elongate connecting member having a first end at or adjacent a bottom of the window frame and an opposing second end at a distance spaced away from the window frame;

a mounting arrangement supporting the connecting member at the wall;

an abutting portion at or adjacent the first end of the connecting member;

a handle spaced from the first end of the connecting member for moving the release mechanism between the first locked position and the second unlocked position;

wherein the abutting portion is positioned beneath the at least one bar section in the first locked position so as to retain the at least one bar section in the first obstructing position above the abutting portion;

wherein the abutting portion is positioned horizontally outward of the at least one bar section in the second unlocked position such that the at least one bar sections is free of the abutting portion and the vertical sliding movement of the at least one bar section is unobstructed by the abutting portion.

In the arrangements as described in more detail hereinafter, the release mechanism may be quickly activated so as to engage the second extended position in an emergency. Also, in a case of accidentally deploying into the second extended position, the window security and escape apparatus may be easier to return to the first obstructing position. In one of the described arrangements, the connecting member is rotated so that the abutting portion which is fixed relative thereto is returned to the first locked position beneath the bar sections in order to return the apparatus to the first obstructing position. Moreover, the arrangement as described hereinafter meets the current codes for window escape devices which require the devices to be keyless and tool-less for moving the device into an extended position for escape.

Note that 'operatively coupled' as used in this specification means that operation of the bar sections and operation of the release mechanism are combined together in a cooperative manner. In other words, the bar sections and the release mechanism have cooperating functions, and respective structures of the bar sections and the release mechanism afford the cooperating functions thereof.

Preferably, the release mechanism is movable between the first locked and second unlocked positions by pivotal movement of the connecting member about an axis defined by said connecting member.

When the release mechanism is movable between its positions by the pivotal movement, optionally the abutting portion comprises a first retaining portion oriented transversely to the axis defined by the connecting member and a second retaining portion oriented parallel to the axis defined by the connecting member so that the connecting member is orientable between upright and horizontal orientations for changing a height of the handle above the support surface. The ability for orienting between vertical and horizontal orientations affords varied spacing of the handle above the support surface, which is especially important for protecting younger individuals from accidentally moving the apparatus into the second extended position.

In one arrangement, the abutting portion is planar and comprises opposing side edges; an outer end edge located horizontally outward of the at least one bar section that spans between the side edges; and an inner end edge at the at least one bar section that follows a bent or curved between the side edges so as to reduce a range of the pivotal movement between the first locked and second unlocked positions. When the inner end edge follows the bent or curved path, in one instance the inner end edge follows the bent or curved path such that a first one of the side edges extends beyond a second one of the side edges at the inner end edge.

It is preferred that the abutting portion comprises a retaining plate movable between the first locked and second unlocked positions by pivotal movement about the axis defined by the connecting member.

When the at least one bar section comprises two bar sections, it is preferred that the abutting portion is positioned beneath each of the two bar sections in the first locked position.

In one arrangement, the connecting member is oriented upright (i.e., in the longitudinal direction) such that the handle of the release mechanism is spaced below the sill of the window frame. The handle is spaced at a sufficing distance below the window frame so that an intruder cannot reach between the bar sections for accessing the handle for moving the bar sections into the second extended position. In addition, the handle is disposed at a position sufficiently close to the floor so as to be accessible to a shorter individual such as a child.

In another arrangement, the connecting member is oriented substantially horizontally (i.e., transversely to the longitudinal direction) such that the handle of the release mechanism is spaced along the wall horizontally outwardly from the side jamb of the window frame. Similarly to the possible upright orientation of the connecting member, the handle is spaced at a sufficing distance away from the window frame so that an intruder cannot reach between the bar sections for accessing the handle for moving the bar sections into the second extended position. In contrast to the possible upright orientation of the connecting member, the handle is disposed at a position sufficiently high from the floor such that a toddler or child cannot accidentally engage the release mechanism for moving the bar sections into the second extended position.

When the connecting member is oriented substantially horizontally, in one arrangement the abutting portion comprises at least one retaining element disposed at a central location intermediate the track members of the at least one bar section such that the at least one bar section is supported by the retaining element inwardly of the track members in the first locked position. For example, the at least one retaining element may comprise a pair of retaining elements at spaced positions along the connecting member such that each retaining element is located on either side of a central plane of the at least one bar section at a substantially equal distance from the central plane. Thus, each side of the bar section is substantially uniformly supported along its length between the main rails. However, in other arrangements the number of retaining elements may be different so long as the retaining elements are arranged in a manner supporting the bar section substantially uniformly along its length.

In one arrangement, for example the one described in the above paragraph, the release mechanism is preferably movable between the first locked and second unlocked positions by the pivotal movement of the connecting member about the axis defined by said connecting member and the handle is operatively coupled to a projecting element which is movable relative to the connecting member so that the projecting element cooperates with a receptacle in the connecting member so as to control movement from the first locked position to the second unlocked position.

Preferably, the projecting element is movable along a control axis which is the same or different axis as that of the connecting member.

In one arrangement, the control axis is parallel to but offset from the axis of the connecting member. Thus, the control axis is separate and spaced from the axis of the connecting member.

In one instance, the release mechanism is movable between the first locked and second unlocked positions by pivotal movement of the connecting member about an axis defined by said connecting member and the handle is operatively coupled to a projecting element which is movable relative to the connecting member so that the projecting element cooperates with a receptacle in the connecting member so as to control movement from the first locked position to the second unlocked position.

In one instance, the handle comprises a handle body and a receptacle in the handle body and the release mechanism further comprises a projecting element affixed to the wall at a position adjacent the handle that is cooperative with the receptacle for maintaining the first locked position. When the handle comprises the handle body and the receptacle therein and the release mechanism has the projecting element, it is preferred that the handle is slidable relative to the connecting member such that the receptacle of the handle is positionable over the projecting element in sliding movement of the handle body so as to receive the projecting element in the receptacle.

According to another aspect of the invention there is provided a combination of a window mounted in a wall at a position spaced above a support surface and a security and escape apparatus comprising:

the window having:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus having:

at least one bar section comprising a pair of upright track members spaced apart from one another and a plurality of bar members extending transversely between the pair of track members at longitudinally spaced positions along the track members;

a pair of main rails oriented upright and respectively mounted to each side jamb so as to be located horizontally outward of the window frame away from the wall;

the track members of a first one of the at least one bar section being mated to the main rails such that the first bar section is vertically slidable relative to the main rails in a longitudinal direction;

the at least one bar section being movable relative to the window frame in vertical sliding movement between a first obstructing position in which at least one of said at least one bar section is obstructing the egress opening and a second extended position in which each bar section is disposed below the egress opening so that the bar members define ladder rungs usable for exiting through the egress opening unobstructed by each bar section;

wherein each main rail is supported by at least one mounting plate fastened by frame fastening elements to the respective side jamb, the at least one mounting plate having an inner face at the side jamb and an outer face, the outer face being at least partially covered by a covering plate such that the frame fastening elements are concealed;

wherein the at least one mounting plate and the covering plate are fastened to the main rail.

The embodiment as described in more detail hereinafter may be easier to install than the prior art window security devices and is designed to make removal of the apparatus from the window frame difficult from outside thereof.

When each main rail comprises the upright channel oriented in the longitudinal direction and the channel is generally U-shaped in cross-section such that the respective rail comprises the longitudinal channel opening, the channel further comprises a base portion directly opposite the channel opening and it is preferred that the at least one mounting plate and the covering plate are fastened by rail fastening elements to the base portion of the channel. Preferably, the rail fastening elements are accessible through the channel opening such that the rail fastening elements are unobstructed by the at least one bar section in the second extended position. Preferably, the rail fastening elements are obstructed by the at least one bar section in the first obstructing position such that the rail fastening elements may not be removed from the respective main rail. Thus, the rail fastening elements are inaccessible in the first obstructing position.

Preferably, the at least one mounting plate further comprises a hooked portion at a position opposite the respective main rail, the hooked portion being curved outwardly from the side jamb to a free hooked end which is at a position spaced from the outer face to accommodate the covering plate on the at least one mounting plate. Preferably, the hooked portion extends across an edge of the covering plate which is adjacent the hooked portion so that the hooked portion is overlapping the covering plate.

According to another aspect of the invention there is provided a security and escape apparatus for use with a window mounted in a wall at a position spaced above a support surface, the window comprising a head at a top of the window; a sill at a bottom of the window; side jambs at opposing sides of the window spanning between the sill and the head; and an egress opening delimited by a window frame which is collectively defined by the sill, head, and side jambs; the apparatus comprising:

at least one bar section comprising a pair of track members spaced apart from one another and a plurality of bar members extending transversely between the pair of track members at longitudinally spaced positions along the track members;

a pair of longitudinally elongate main rails arranged for respectively mounting to each side jamb of the window so as to locate the at least one bar section spaced from the wall yet in close relation to the window frame;

the track members of a first one of the at least one bar section being arranged for mating with the main rails such that the first bar section is slidable relative to the main rails in a longitudinal direction of the main rails;

the at least one bar section being arranged for sliding movement relative to the main rails between a first retracted position in which the at least one bar section is disposed adjacent the main rails in a direction normal to the longitudinal direction of the main rails and a second extended position in which each bar section is disposed adjacent the main rails in the longitudinal direction of the main rails;

whereby in the first retracted position the at least one bar section is arranged to obstruct the egress opening;

whereby in the second extended position each bar section is arranged to be disposed below the egress opening so that the bar members define ladder rungs usable for exiting through the egress opening unobstructed by each bar section; and wherein the at least one bar section comprises two bar sections, a second one of the bar sections arranged for mating with the first bar section so as to be slidable relative to the first bar section;

wherein each track member of the first bar section comprises a pair of channels which are disposed side-by-side in a direction transverse to a longitudinal direction of the respective one of the track members of the first bar section, a first one of the channels arranged to slidably receive one of the main rails therein and a second one of the longitudinal channels arranged to slidably receive one of the track members of the second bar section therein such that at least one bar member of the first bar section and at least one bar member of the second bar section are equal in length between the track members of the respective bar section.

According to another aspect of the invention there is provided a security and escape apparatus for use with a window mounted in a wall at a position spaced above a support surface, the window comprising a head at a top of the window; a sill at a bottom of the window; side jambs at opposing sides of the window spanning between the sill and the head; and an egress opening delimited by a window frame which is collectively defined by the sill, head, and side jambs; the apparatus comprising:

at least one bar section comprising a pair of track members spaced apart from one another and a plurality of bar members extending transversely between the pair of track members at longitudinally spaced positions along the track members;

a pair of longitudinally elongate main rails arranged for respectively mounting to each side jamb of the window so as to locate the at least one bar section spaced from the wall yet in close relation to the window frame;

the track members of a first one of the at least one bar section being arranged for mating with the main rails such that the first bar section is slidable relative to the main rails in a longitudinal direction of the main rails;

the at least one bar section being arranged for sliding movement relative to the main rails between a first retracted position in which the at least one bar section is disposed adjacent the main rails in a direction normal to the longitudinal direction of the main rails and a second extended position in which each bar section is disposed adjacent the main rails in the longitudinal direction of the main rails;

whereby in the first retracted position the at least one bar section is arranged to obstruct the egress opening;

whereby in the second extended position each bar section is arranged to be disposed below the egress opening so that the bar members define ladder rungs usable for exiting through the egress opening unobstructed by each bar section; and a release mechanism arranged for operatively coupling to the bar sections so as to be movable between a first locked position in which the release mechanism retains the at least one bar section in the first retracted position and a second unlocked position in which the release mechanism frees the at least one bar section for moving into the second extended position;

the release mechanism comprising:

an elongate connecting member having a first end arranged to be positioned at or adjacent a bottom of the window frame and a second end in spaced relation to the first end that is arranged to be positioned at a distance spaced away from the window frame;

a mounting arrangement arranged for supporting the connecting member at the wall;

an abutting portion at or adjacent the first end of the connecting member;

a handle spaced from the first end of the connecting member for moving the release mechanism between the first locked position and the second unlocked position;

wherein the abutting portion is positionable longitudinally inline with the at least one bar section in the first locked position so as to retain the at least one bar section in the first retracted position to one side of the abutting portion;

wherein the abutting portion is positionable outward of the at least one bar section in the second unlocked position such that the at least bar section is free of the abutting portion and the sliding movement of the at least one bar section is unobstructed by the abutting portion.

According to another aspect of the invention there is provided a security and escape apparatus for use with a window mounted in a wall at a position spaced above a support surface, the window comprising a head at a top of the window; a sill at a bottom of the window; side jambs at opposing sides of the window spanning between the sill and the head; and an egress opening delimited by a window frame which is collectively defined by the sill, head, and side jambs; the apparatus comprising:

at least one bar section comprising a pair of track members spaced apart from one another and a plurality of bar members extending transversely between the pair of track members at longitudinally spaced positions along the track members;

a pair of longitudinally elongate main rails arranged for respectively mounting to each side jamb of the window so as to locate the at least one bar section spaced from the wall yet in close relation to the window frame;

the track members of a first one of the at least one bar section being arranged for mating with the main rails such that the first bar section is slidable relative to the main rails in a longitudinal direction of the main rails;

the at least one bar section being arranged for sliding movement relative to the main rails between a first retracted position in which the at least one bar section is disposed adjacent the main rails in a direction normal to the longitudinal direction of the main rails and a second extended position in which each bar section is disposed adjacent the main rails in the longitudinal direction of the main rails;

whereby in the first retracted position the at least one bar section is arranged to obstruct the egress opening;

whereby in the second extended position each bar section is arranged to be disposed below the egress opening so that the bar members define ladder rungs usable for exiting through the egress opening unobstructed by each bar section; and wherein each main rail is arranged to be supported by at least one mounting plate fastenable by frame fastening elements to the respective side jamb, the at least one mounting plate having an inner face arranged to be at the side jamb and an outer face arranged to be at least partially covered by a covering plate such that the frame fastening elements are concealed;

wherein the at least one mounting plate and the covering plate are fastenable to the main rail.

All or any of the above features may be combined with one another.

BRIEF DESCRIPTION OF THE DRAWINGS

Preferred arrangements of the invention will now be described in conjunction with the accompanying drawings in which.

In the drawings like characters of reference indicate corresponding parts in the different figures.

DETAILED DESCRIPTION

Figure 1:
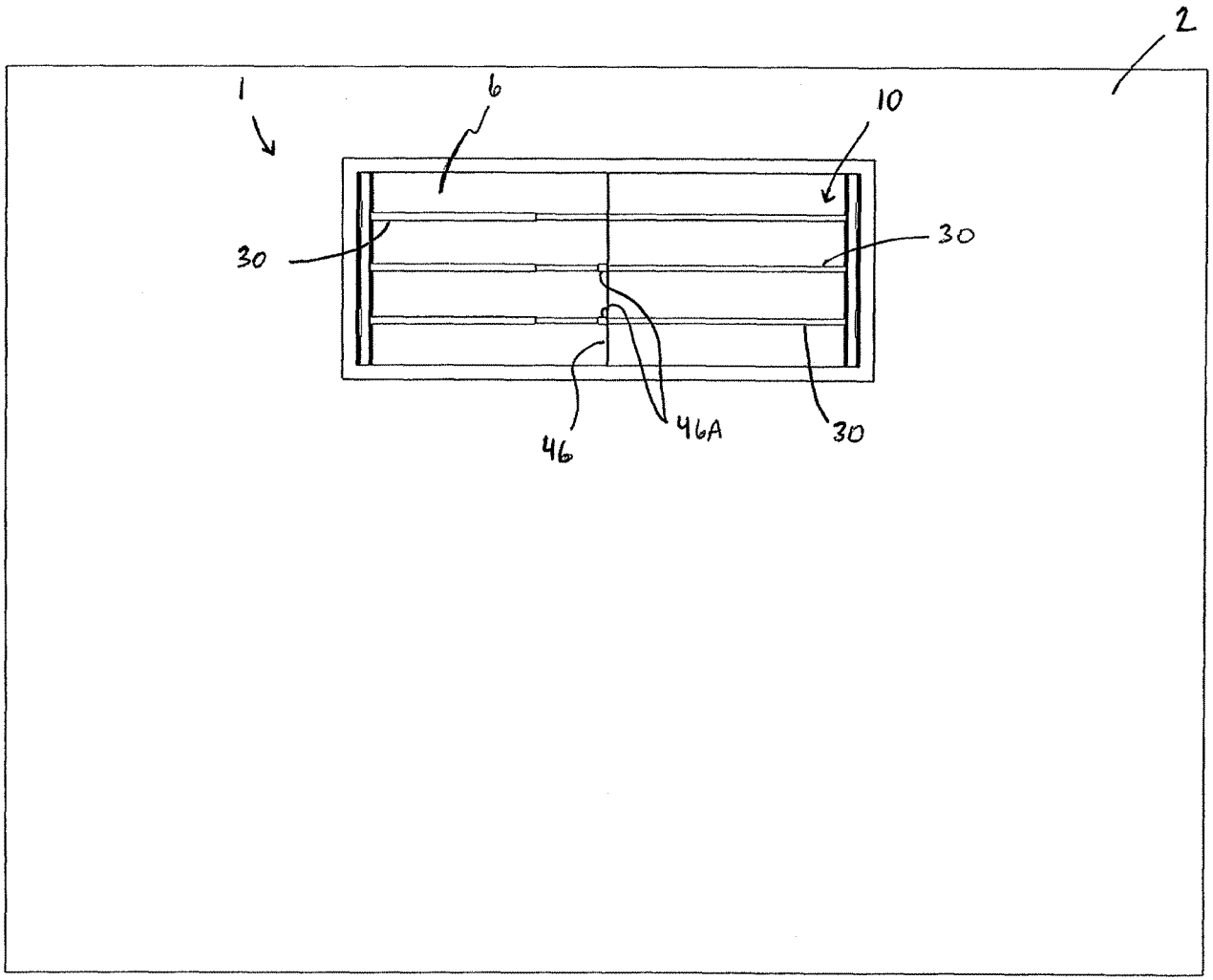
FIG. 1 is an outside elevation view of a security and escape apparatus of the present invention shown in a first obstructing position.

Referring to the accompanying figures there is illustrated a security and escape apparatus generally indicated by reference numeral 10. The apparatus 10 is suited for use with a window 1 mounted in a wall 2 at a position spaced above a support surface 3. More particularly, the apparatus is suited for mounting on an inside of the window and the wall.

Generally speaking, the window 1 comprises a head 4A at a top of the window; a sill 4B at a bottom of the window; and side jambs 4C, 4D at opposing sides of the window spanning between the sill 4B and the head 4A. Typically, the window is rectangularly shaped such that the head and sill are in parallel relation to one another and the side jambs are parallel to one another. As such, the head, sill, and side jambs collectively define a window frame 5 of the window. The window frame may be made of suitable materials such as wood and plastic. Also, in an alternative embodiment the window may comprise a window opening in a wall such that the window frame is defined by portions of the wall delimiting the window opening. The window also includes an egress opening 6 delimited by the window frame. In the illustrated embodiment, the window 1 is a basement window. As such, the egress opening 6 of the illustrated embodiment is larger in a horizontal transverse direction than in a vertical longitudinal direction. Furthermore, in the illustrated embodiment the sill 4B is spaced at least a couple of meters above the support surface such that the egress opening 6 is not easily accessible for exit therethrough in an emergency.

Turning now to the security and escape apparatus, the apparatus 10 comprises a pair of main rails 12. Each main rail comprises a C-channel such that the main rail has a longitudinal channel opening 14A along a longitudinal length of the rail 12. Further to the channel opening, the main rail comprises opposing side portions 14B, 14C and a base portion 14D spanning therebetween located opposite the channel opening. The main rail 12 is open at longitudinal ends thereof. In use, the main rails are oriented vertically upright in parallel relation to one another.

Figure 7:
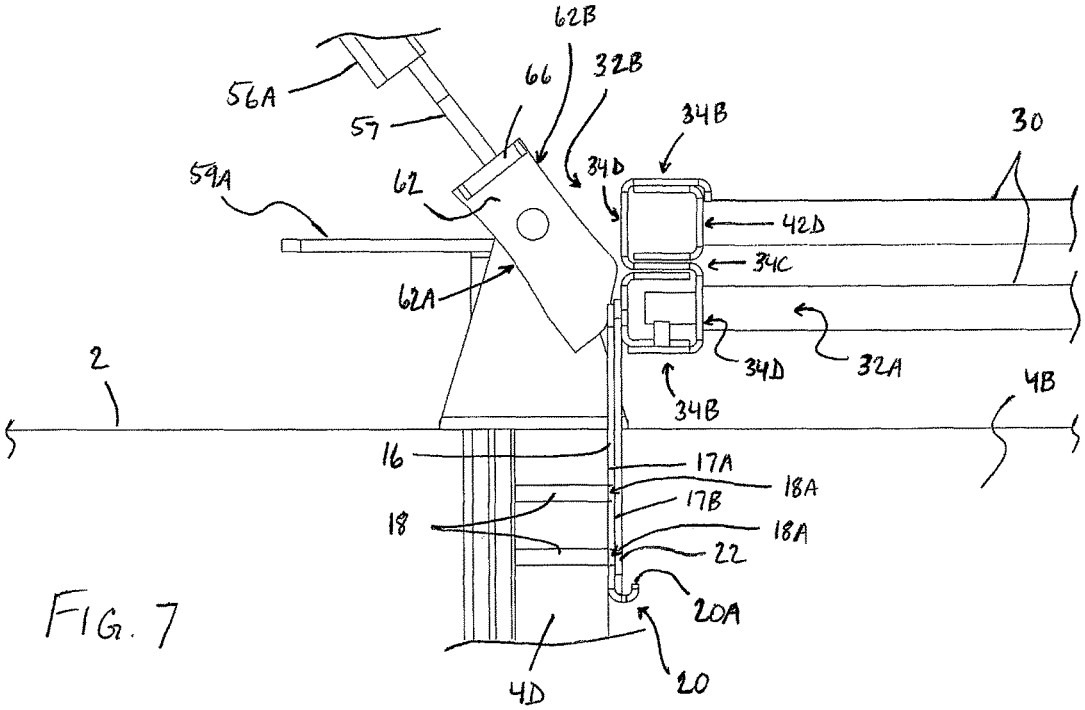
FIG. 7 is a cross-sectional view along line 7-7 of the release mechanism as shown in FIG. 3 positioned in a second unlocked position so as to be freed from beneath the bar sections.
Figure 8:
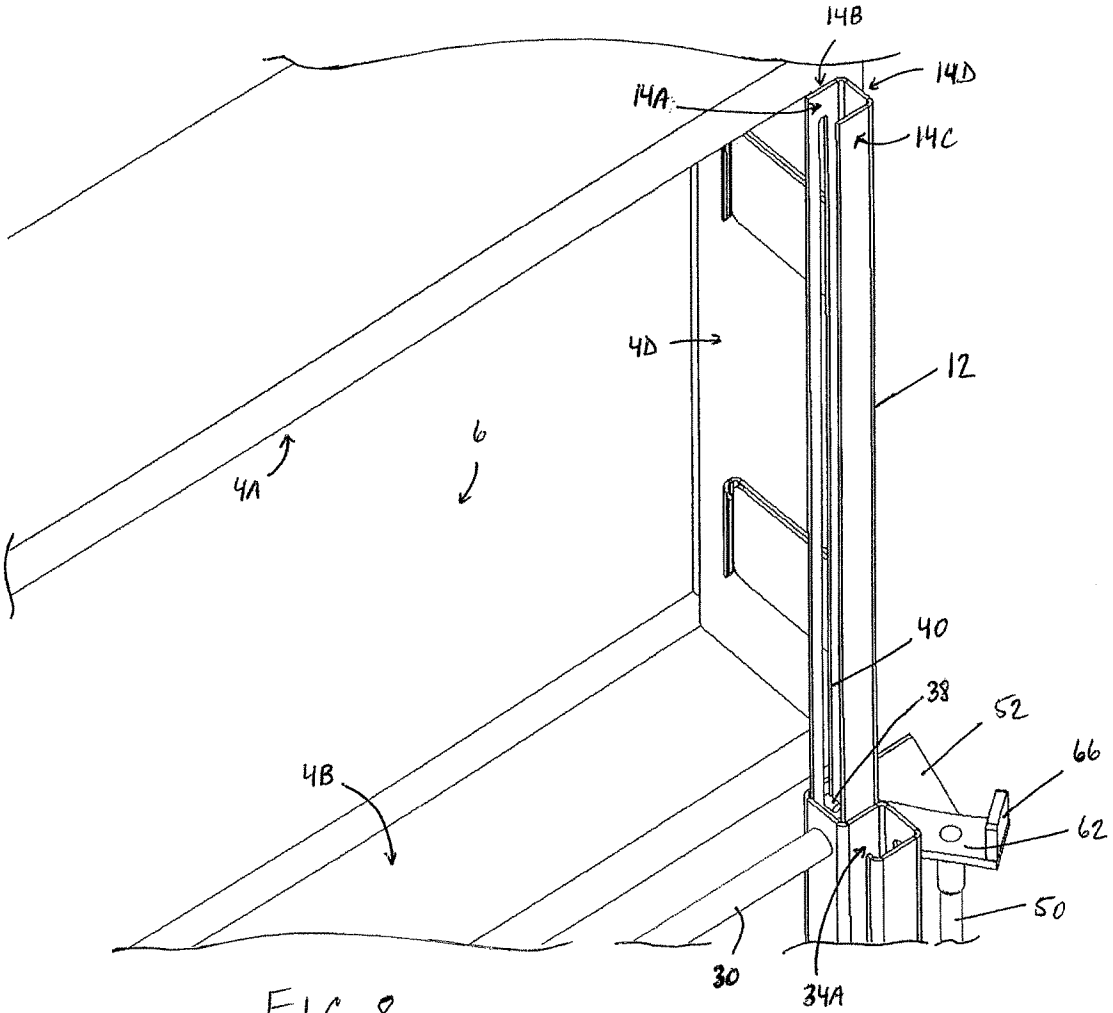
FIG. 8 is a perspective view of the apparatus in the second extended position more clearly illustrated a guiding slot and a projecting guide element.

Furthermore, in use each main rail 12 is mounted to the respective side jamb 4C or 4D so as to be located horizontally outwardly of the window frame 5 away from the wall 2. Each rail is supported at the respective side jamb by a pair of mounting plates 16 which are vertically spaced apart from one another. Each mounting plate 16 is fastened by frame fastening elements 18 to the respective side jamb as shown in FIG. 7. The frame fastening elements 18 may comprise screws of a regular or special variety depending on the material of the side jambs 4C, 4D. In alternative embodiments, the mounting plates 16 may be fastened to the side jambs by an adhesive.

Each mounting plate 16 has an inner face 17A arranged to be mounted flush with the side jamb 4C or 4D. As such, the inner face 17A is smooth. The mounting plate also has an outer face 17B at which the frame fastening elements are accessible. In the illustrated embodiment, head ends 18A of the frame fastening elements are flush or recessed from the outer face 17B. As such, the outer face is free of projections therefrom.

Each mounting plate 16 further includes a hooked portion 20 at a position opposite the respective main rail 12 which is fastened to the mounting plate 16 at the base portion 14D of the main rail. As such, the hooked portion is located closer to an outer side of the window frame and wall than a location of the respective main rail relative to the outer side of the window frame. The hooked portion 20 is curved from the respective side jamb 4C or 4D, to which the mounting plate is fastened, inwardly towards the opposing side jamb 4D or 4C. That is, the hooked portion is curved from the respective side jamb to a free hooked end 20A which is at a position spaced from the outer face of the mounting plate. The hooked portion is convex relative to an outside of the window as more clearly illustrated in FIG. 7.

Further to the mounting plate, a covering plate 22 is received on the outer face 17B of each mounting plate 16 so as to conceal the frame fastening elements 18. The covering plate 22 is generally rectangular in shape and has a smooth inner face in butting engagement with the outer face 17B of the respective mounting plate. The covering plate 22 is received between the free hooked end 20A of the hooked portion and the outer face 17B of the mounting plate such that the free hooked end extends across an edge of the covering plate 22 adjacent and at the hooked portion 20 so that the hooked portion is overlapping the covering plate. Moreover, both the covering plate and the mounting plate are fastened in an overlapping arrangement to the base portion 14D of the respective main rail by rail fastening elements 24. As such, the covering plate 22 is sandwiched between the main rail 12 and the mounting plate 16, and the rail fastening elements 24 are accessible through the channel opening 14A of the main rail. Based on this arrangement of the covering plate and mounting plate described hereinbefore, it may be difficult for an individual such as an intruder to pry apart the covering plate from butting engagement with the mounting plate for accessing the frame fastening elements 18 in order to remove same so as to dismantle the security and escape apparatus for passing through the window. It will be appreciated that in this arrangement the main rails 12 are oriented so that the channel openings 14A thereof respectively face inwardly towards one another.

Further to the main rails, the apparatus comprises two bar sections 26A and 26B. Each bar section 26A, 26B comprises a pair of track members. The track members of the bar section 26A are indicated by reference numeral 28A. Similarly, the track members of the bar section 26B are indicated by reference numeral 28B. Each bar section further comprises a plurality of bar members 30 extending between the pair of track members 28A or 28B at spaced positions along the track members. In use, the track members that define each pair thereof are oriented vertically upright and are horizontally spaced apart from one another such that the track members of the respective pair are in parallel relation relative to one another. Furthermore, the bar members 30 extend horizontally transversely between the track members and the bar members of each bar section are at longitudinally spaced positions along the track members.

Each track member 28A of a first or main one of the bar sections 26A comprises a pair of main track channels 32A and 32B which are elongate and disposed side-by-side in a parallel condition. Each of the main track channels 32A, 32B comprises a C-channel similar in shape to that of the main rail. As such, each one of the main track channels has a channel opening 34A along a longitudinal length of the respective channel 32A or 32B, opposing side portions 34B and 34C, and a base portion 34D spanning between the side portions 34B, 34C opposite the channel opening 34A. The main track channels are open at longitudinal ends thereof. More particularly, the main track channels are contiguous such that the main track channels 32A and 32B share a common side portion 34C. Furthermore, the channel openings 34A are located on opposing sides of the track member 28A such that each track member of the main bar section is S-shaped in end view thereof. Each track member 28A of the main bar section 26A is oriented as a mirror image of the opposing track member. Thus, inner sides of the track members 28A locate across from one another the base portions 34D of one pair of opposite main track channels 32A and the channel openings 34A of another pair of opposite main track channels 32B. The pair of main track channels having the base portions 34D thereof located across from one another define a primary pair of channels 36A. Similarly, the pair of main track channels having the channel openings 34A thereof located across from one another define a secondary pair of channels 36B. The bar members 30 of the main bar section 26A are disposed between the base portions 34D of the primary pair of channels 36A. Furthermore, the primary pair of channels are arranged to receive therein the main rails 12 in slidable mating engagement with the primary pair of channels.

An outer one 34B of each side portion of the primary pair of channels 36A in the main track members 28A comprises a projecting guide element 38, such as a pin, protruding inwardly from the outer side portion 34B towards the opposing side portion 34C in common with the adjacent channel 32B. The projecting element is sized for mating in a longitudinally elongate guiding slot 40 in each one of the main rails 12 formed in a corresponding one of the side portions 14B of the respective main rail. The guiding slot 40 is closed at a bottom end adjacent a bottom of the respective main rail. The projecting guide element 38 of the track member 28A of the main bar section and the guiding slot 40 of the main rail 12 cooperatively guide the sliding movement of the main bar section 26A along the main rails. In particular, the closed bottom end of the guiding slot holds the main bar section in mating engagement with the main rails when the main bar section is moved downward to the bottom ends of the main rails. In the illustrated embodiment, a top end of the guiding slot is also closed such that the main bar section remains mated with the main rails when the main bar section is moved to an upper limit of its vertical movement.

The track members 28B of a second or auxiliary one of the bar sections 26B comprise C-channels like that of the main rails 12. Correspondingly, each auxiliary track channel has a channel opening 42A along a longitudinal length thereof, opposing side portions 42B and 42C, a base portion 42D spanning between the side portions 42B, 42C opposite the channel opening 42A, and open channel ends at longitudinal ends of the track member 28B. The bar members 30 of the auxiliary bar section 26B span between the base portions 42D at inner sides of the track members 28B of the auxiliary bar section. The track members of the auxiliary bar section are arranged to be slidably mated with the secondary pair of channels 36B so as to be vertically slidable therealong.

In this arrangement, the track members 28A of the main bar section are shaped such that the base portions 34D and 42D of the respective pair of track members of each of the main 26A and auxiliary bar sections 26B are uniformly spaced apart such that the bar members 30 of the main 26A and auxiliary 26B bar sections are equal in length between the respective pair of track members 28A or 28B.

In use, the track members 28A of the main bar section 26A are mated with the main rails 12 such that the main bar section is disposed between the main rails 12 and that the main bar section is vertically slidable relative to the main rails in the longitudinal direction. As such, the channel openings 34A of the primary pair of channels 36A are oriented horizontally outwardly along the wall, and the channel openings 34A of the secondary pair of channels 36B are oriented horizontally inwardly towards one another.

Figure 4:
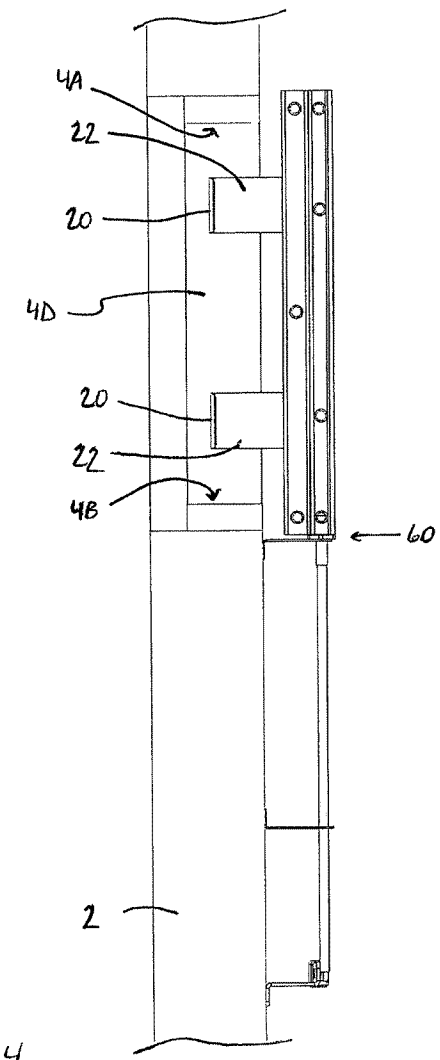
FIG. 4 is a cross-sectional view of the apparatus of FIG. 1 along line 4-4 illustrating the apparatus in the first obstructing position.

The bar members 30 of each of the two bar sections are spaced along the respective pair of track members 28A or 28B so that the bar members intermediate a topmost and bottommost bar member of each bar section are staggered relative to the intermediate bar members of the other bar section when the auxiliary bar section is fully received in the secondary pair of channels of the main bar section. This staggered relationship or arrangement is more clearly illustrated in FIG. 4.

Further to the track members, a length of each bar member 30 of each one of the bar sections 26A or 26B is adjustable such that lateral spacing between the main rails 12 is adjustable for fitting the window frame 5. Each bar member is defined by a plurality of telescoping members 44A, 44B which are slidable relative to one another in telescoping configuration. More particularly, a first one of the telescoping members 44A extending from one track member of the respective bar section is received in a second one of the telescoping members 44B which is extending from an opposing track member of the respective bar section 26A or 26B.

Moreover, each bar section 26A and 26B includes an upright support member 46 spanning longitudinally between the bar members 30 at a position intermediate the track members 28A or 28B corresponding to the appropriate bar section 26A or 26B. The upright support member 46 may provide additional support near a midpoint of the respective bar members 30 to resist sag or bending thereof. In the illustrated embodiment, the upright support member 46 comprises a longitudinally elongate plate locating apertures therealong. The upright support member is oriented vertically upright and in a plane normal to the wall such that the bar members 30 of the respective bar section pass through the apertures of the upright support member 46. As such, the upright support member bridges the topmost, bottommost, and intermediate ones of the bar members 30 of each bar section. Moreover, in the illustrated embodiment the upright support member 46 is slidable along the bar members between the track members such that the support member can be positioned intermediate the track members of the respective bar section 26A, 26B once the width of the bar section is properly adjusted for the window 1. As such, each upright support member includes a collar 46A at one of the apertures of the support member extending transversely from the plate. The collar 46A receives one of the bar members therethrough and is suited for maintaining a position of the plate of the support member 46 along the bar members 30, which is preferably halfway between the respective track members.

Figure 2:
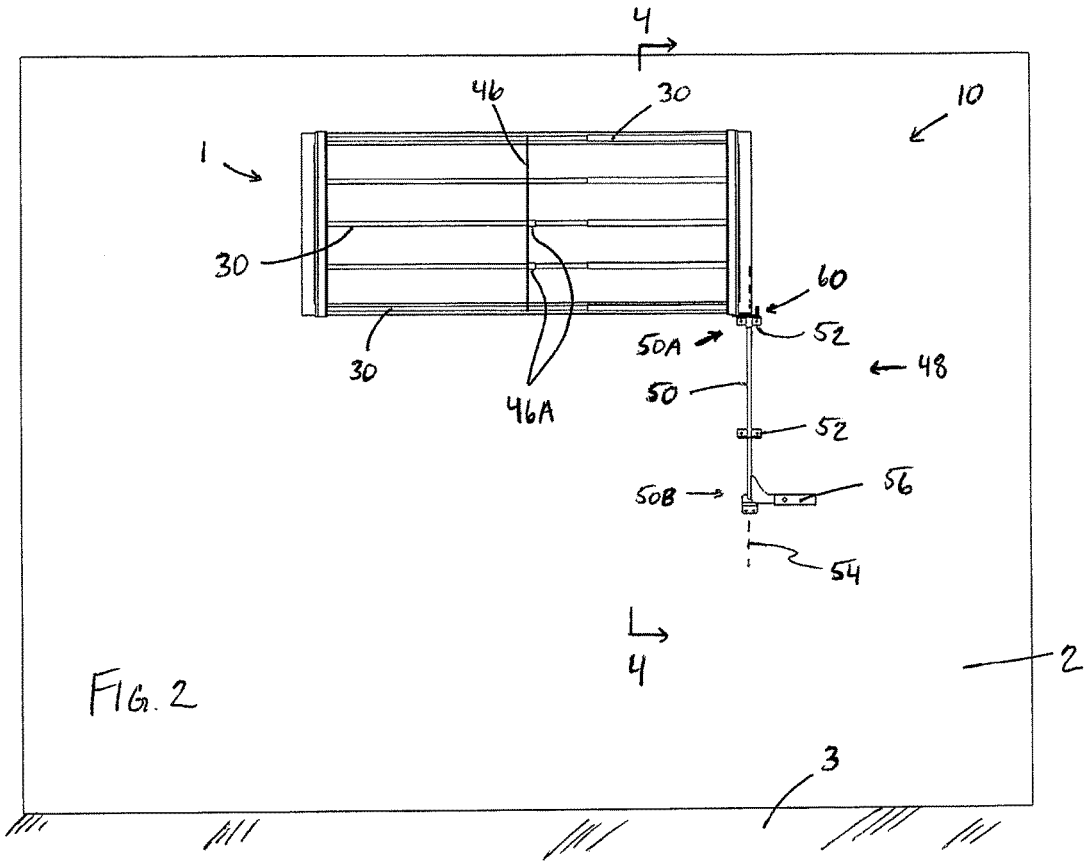
FIG. 2 is an inside elevation view of the apparatus of FIG. 1 in the first obstructing position and having the connecting member mounted vertically.
Figure 3:
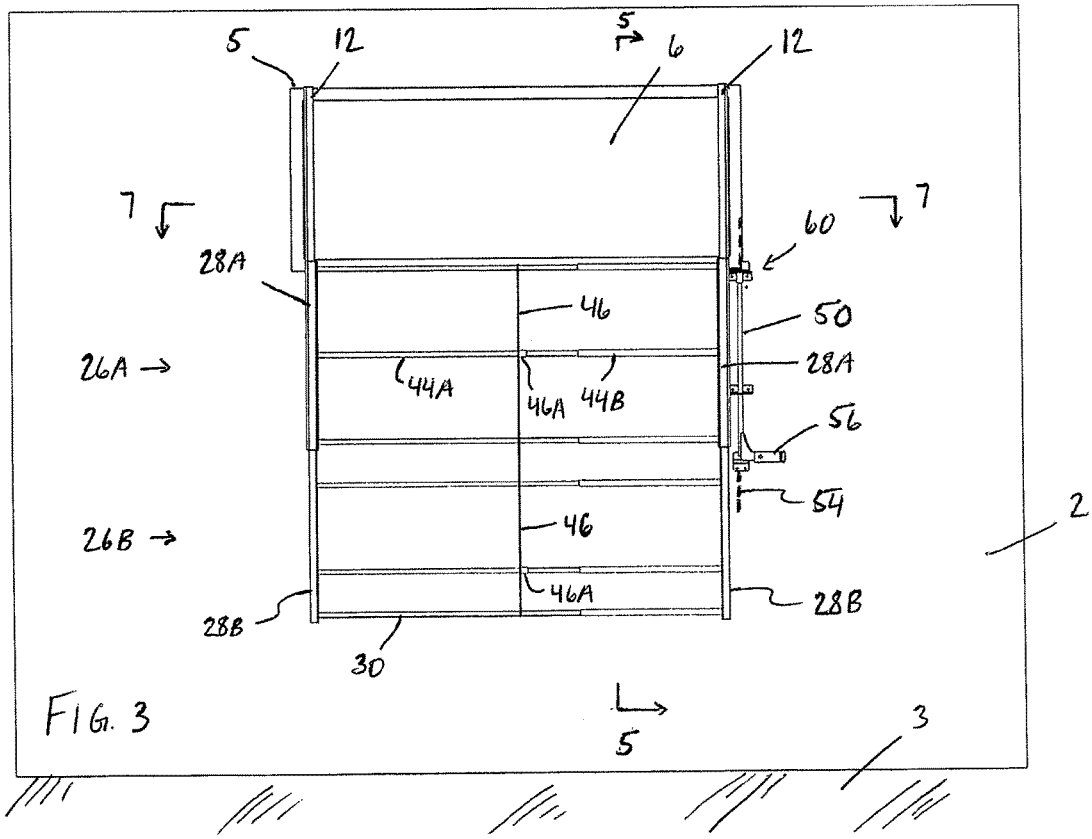
FIG. 3 is an inside elevation view like that in FIG. 2 showing the apparatus in a second extended position.

In general, the bar sections are arranged to be movable relative to the window frame 5 in vertical sliding movement between a first obstructing position, as shown in FIG. 2 for example, in which the bar sections 26A, 26B are obstructing the egress opening 6 by spanning across the egress opening and a second extended position, as shown in FIG. 3 for example, in which each bar section 26A, 26B is disposed below the sill of the window 1 so that the bar members 30 define ladder rungs for exiting through the egress opening 6 that is unobstructed by each bar section 26A, 26B. Typically, a user exits the egress opening 6 by climbing up the rungs. Movement from the first obstructing position to the second extended position is primarily by force of gravity pulling each bar section 26A, 26B downwardly towards the support surface 3.

Figure 6:
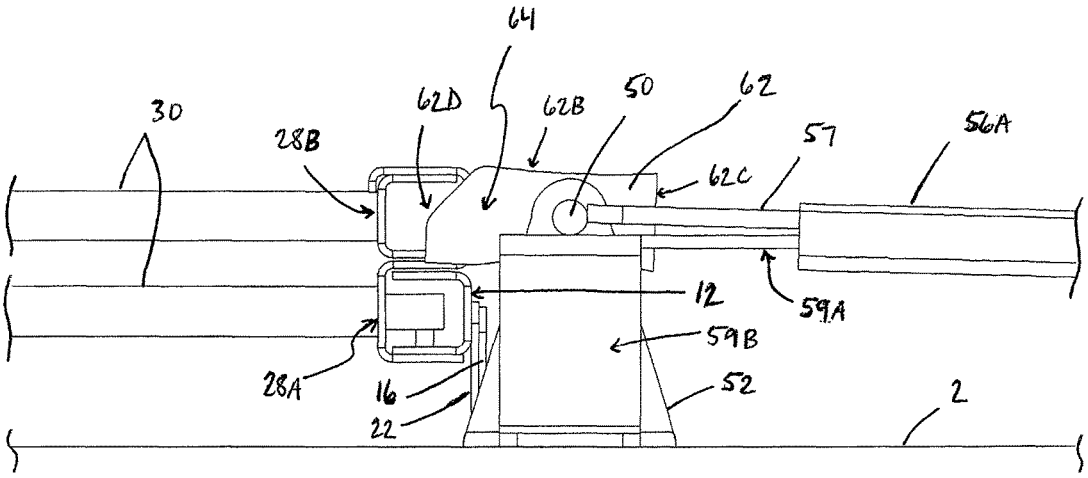
FIG. 6 is a bottom view of a release mechanism of the present invention as shown in FIG. 2 positioned in a first locked position so as to hold bar sections in the first obstructing position.
Figure 11:
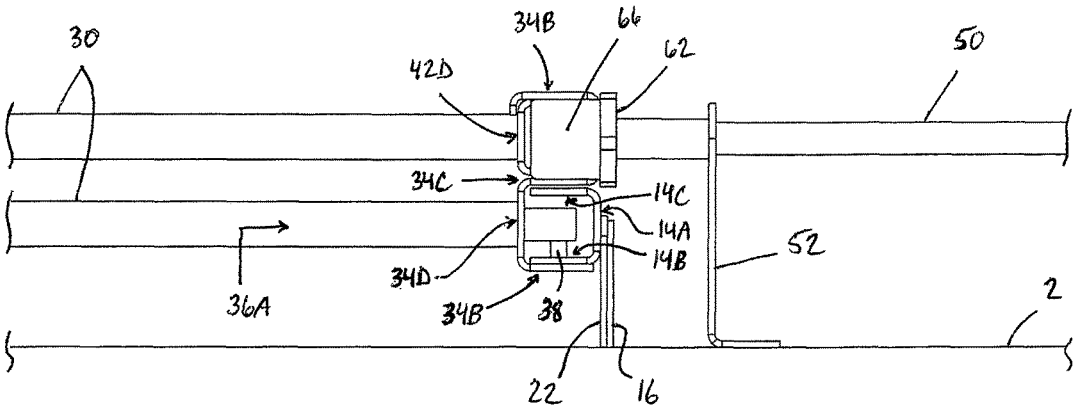
FIG. 11 is a bottom view of the release mechanism as shown in FIG. 9 retaining the bar sections in the first obstructing position.

To control movement from the first obstructing position into the second extended position, the security and escape apparatus 10 comprises a release mechanism 48 operatively coupled to the bar sections 26A, 26B. The release mechanism is positionable in a first locked position, more clearly illustrated in FIGS. 6 and 11, in which the release mechanism is abutting bottoms of the bar sections so as to retain the bar sections in the first obstructing position. The release mechanism 48 is further positionable in a second unlocked position in which the release mechanism is free of butting engagement with bar sections so that the bar sections are unobstructed and free to move downwardly into the second extended position.

The release mechanism 48 comprises an elongate connecting member 50 having a first end 50A at or adjacent the sill of the window and an opposing second end 50B at a distance spaced away from the window frame 5. In the illustrated embodiment, the connecting member comprises a rod 50. The release mechanism further includes a mounting arrangement 52 arranged for supporting the connecting member on the wall. In the illustrated embodiment, the mounting arrangement comprises a plurality of mounting brackets arranged for mounting to the wall. The brackets are located at spaced positions along a length of the rod 50.

In order to move between the first locking and second unlocking positions, the rod 50 is arranged for pivotal movement about a longitudinal axis 54 defined by the rod. The mounting brackets include apertures arranged for receiving the rod therethrough for guiding the rod in its pivotal movement such that the axis 54 of the pivotal movement may be defined by the rod.

Figure 13:
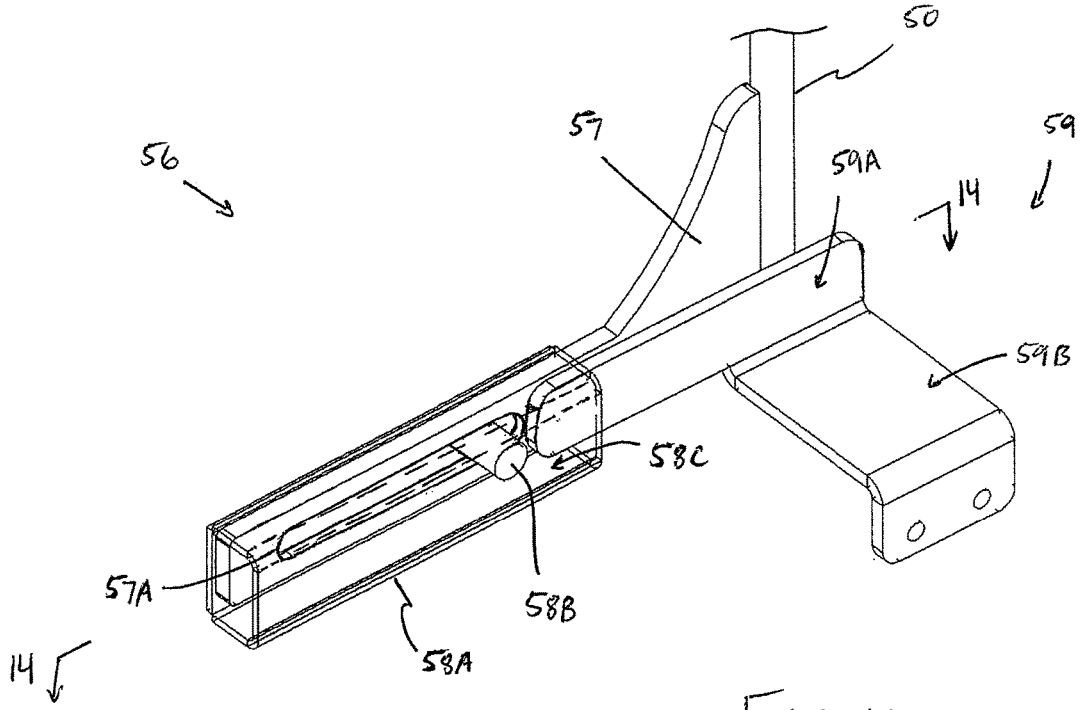
FIG. 13 is a schematic view of a handle slidably positioned over a projecting element mounted to a wall for retaining the first locked position of the release mechanism (the wall is omitted for clarity of illustration).
Figure 14:
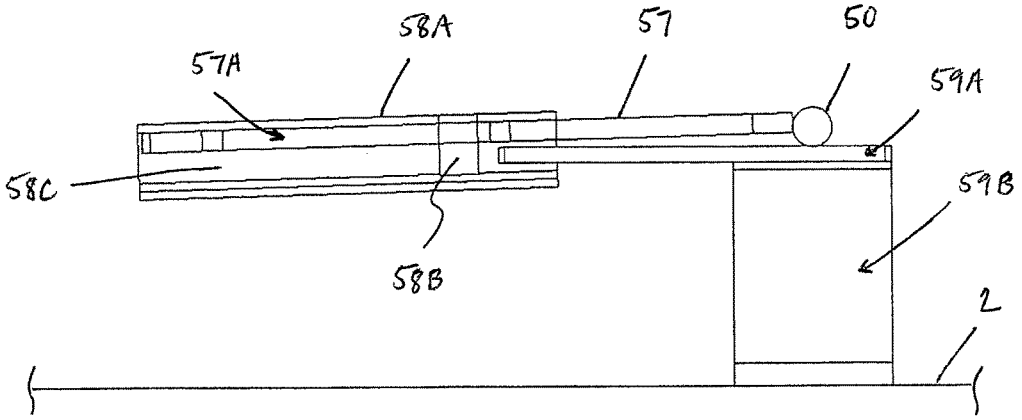
FIG. 14 is a cross-sectional view along line 14-14 of the handle as shown in FIG. 13.
Figure 15:
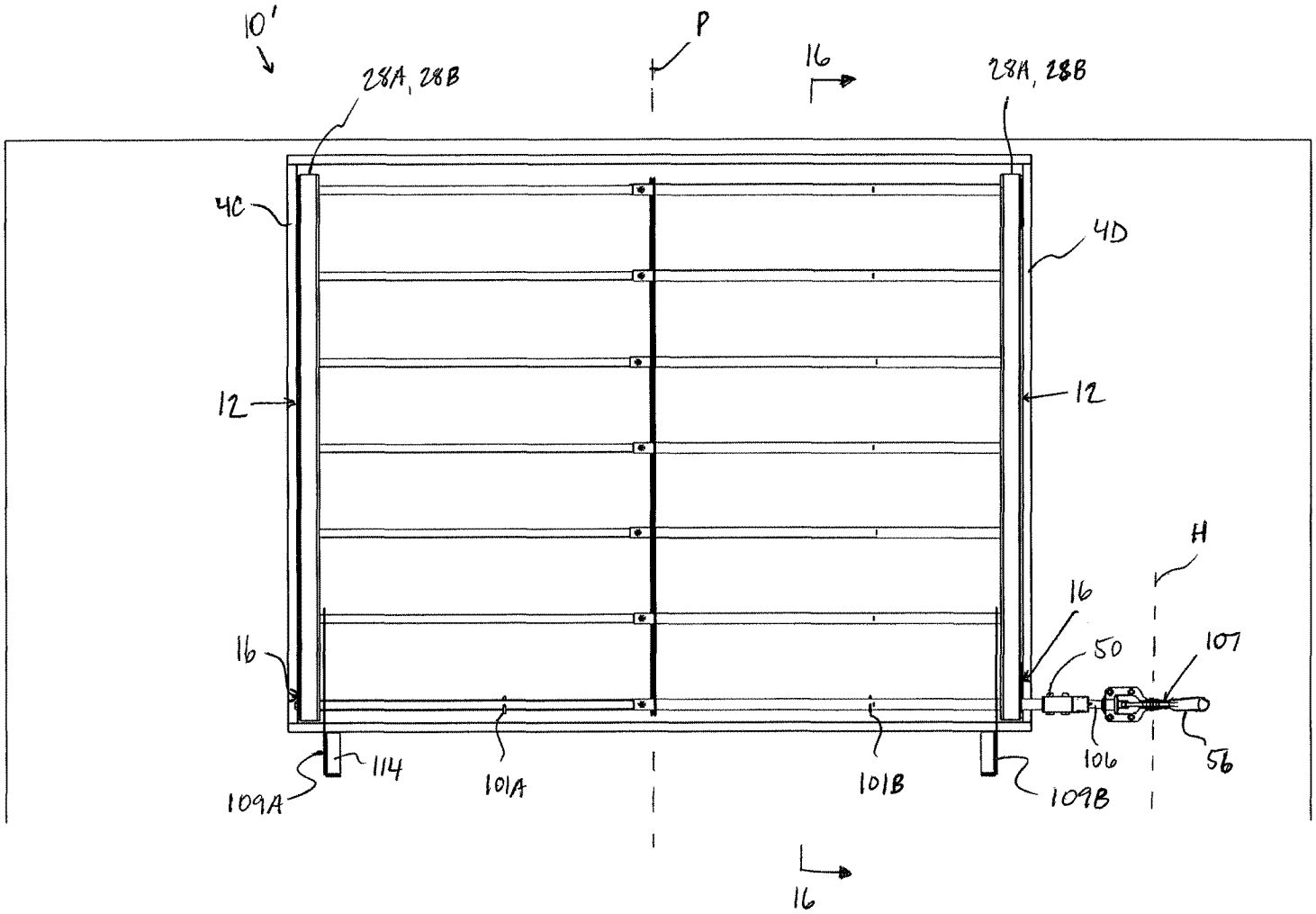
FIG. 15 is an inside elevational view of another arrangement of security and fire escape apparatus shown in a first obstructing position.
Figure 16:
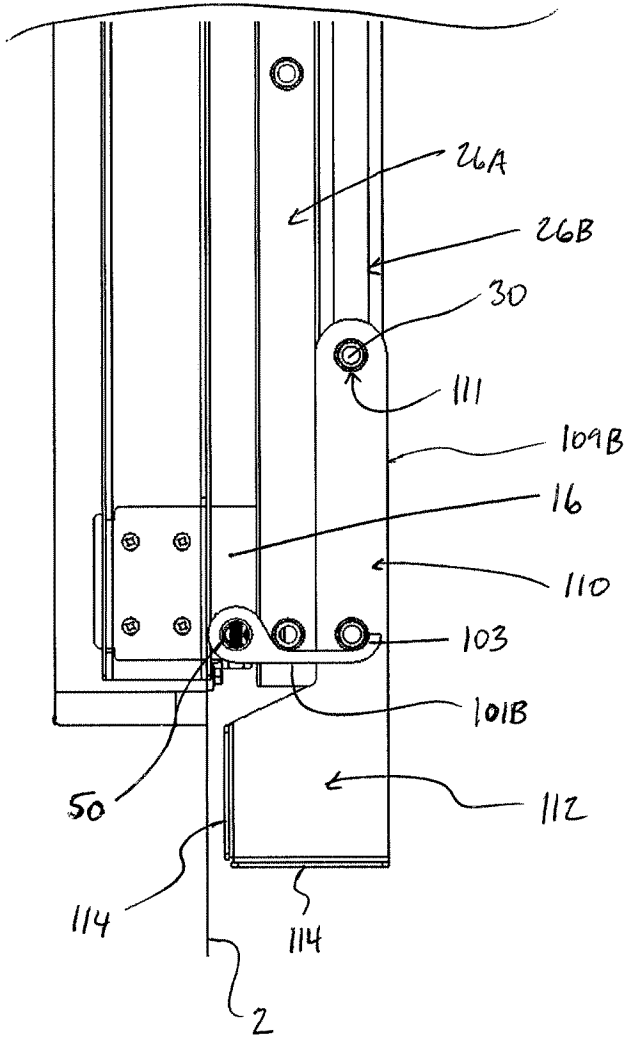
FIG. 16 is a cross-sectional view along line 16-16 in FIG. 15.
Figure 17:
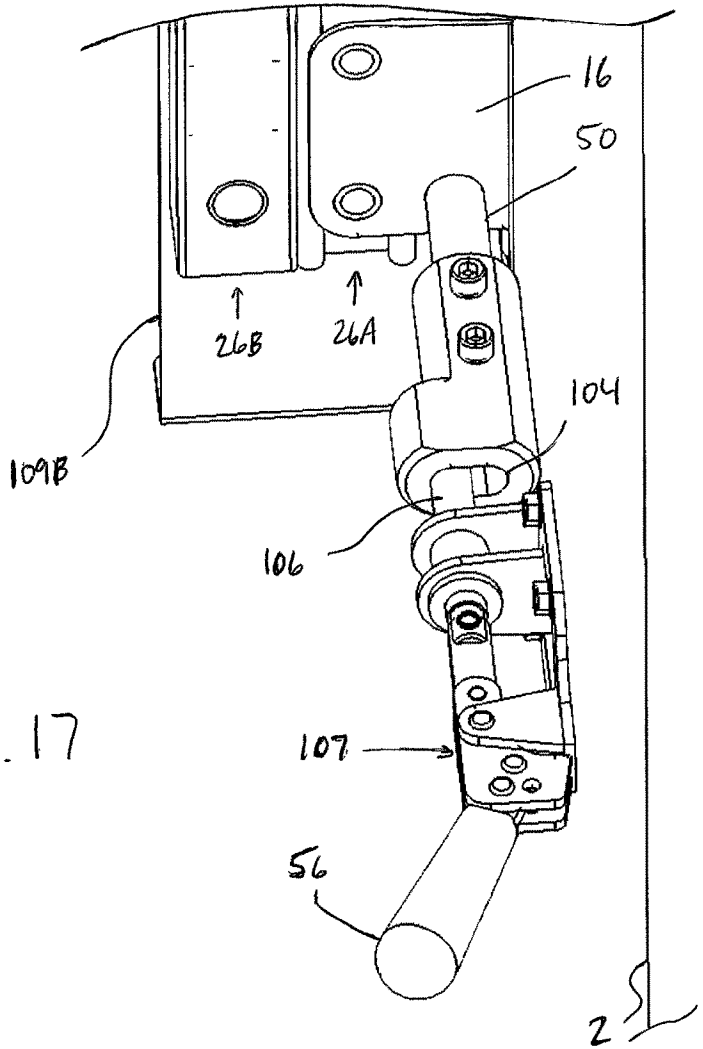
FIG. 17 is a perspective view from one side of the arrangement of FIG. 15.
Figure 18:
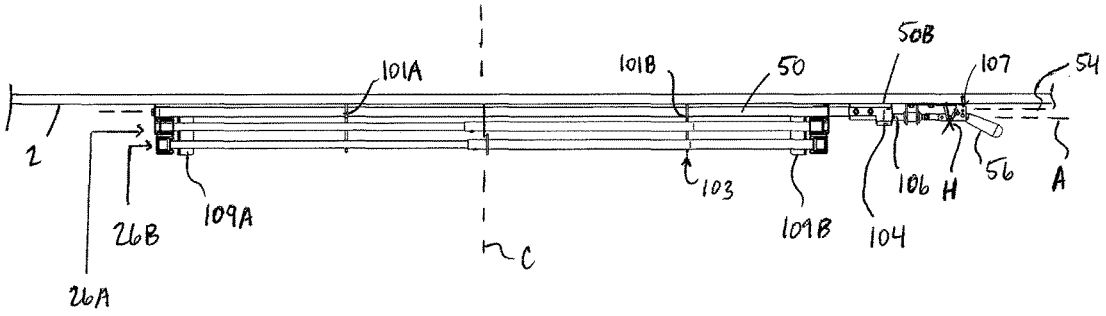
FIG. 18 is a top plan view of the arrangement of FIG. 15 in the first obstructing position where a receptacle in a connecting member is shown schematically.
Figure 19:
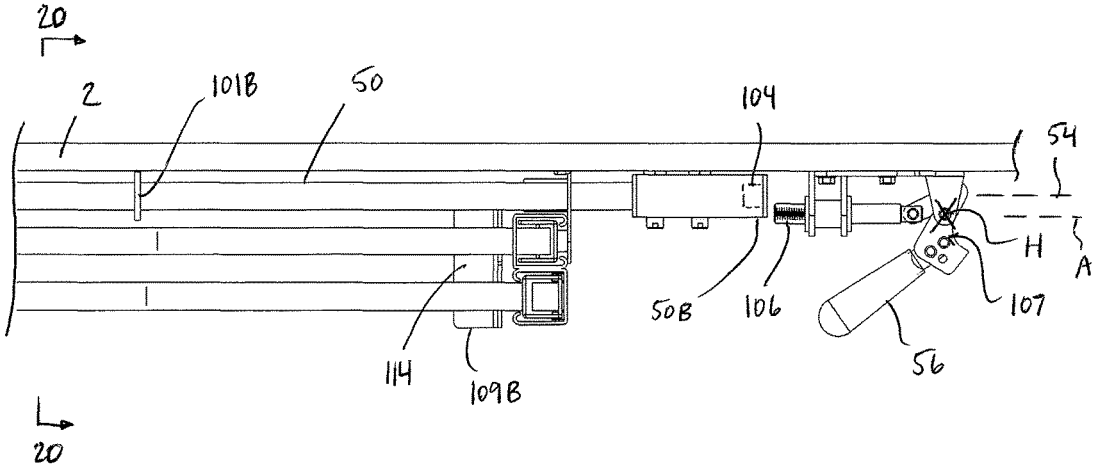
FIG. 19 is an enlarged top plan view of a portion of the arrangement of FIG. 15 in a second extended position where the receptacle in the connecting member is shown schematically.

The release mechanism includes a handle 56 spaced from the first end 50A of the rod and extending transversely to the rod 50 so as to be arranged to effect movement between the first locked and second unlocked position by rotating the rod. In the illustrated embodiment, the handle 56 is located at the second end 50B of the rod. The handle comprises an attachment portion 57 connected to the rod 50 so as to project transversely therefrom. The handle further includes a handle body 58A which is received over the attachment portion. Furthermore, a handle guiding element 58B, such as a pin, is disposed within the handle body so as to project from one inner face of the handle body to an opposing inner face thereof. The handle guide element 58B is mated with a handle guiding slot 57A in the attachment portion adjacent a free end thereof. The handle guiding slot 57A is elongate in a direction transverse to the axis 54 of the rod. As such, the handle body is slidable along the handle guiding slot 57A of the attachment portion in the transverse direction of the rod 50. Furthermore, the handle body is hollow and has an open end such that an inside of the handle body and the open end thereof defines a receptacle 58C which is cooperative with a projecting element 59 mounted to the wall 2. The handle body 58A is positionable over the projecting element 59 in sliding movement of the body 58A such that the projecting element is received in the receptacle 58C in a space between the attachment portion 57A and the opposing inner face of the handle body that is free of the handle guide element 58B. As such, the projecting element 59 and the receptacle 58A collectively define a retaining mechanism, as better shown in FIGS. 13 and 14, for maintaining the first locked position of the release mechanism.

Turning now to the projecting element, the projecting element 59 is affixed to the wall 2 at a position immediately adjacent the handle 56 so as to be at a uniform height as the handle above the support surface 3. The projecting element comprises a projecting portion 59A and a mounting portion 59B arranged for spacing the projecting portion from the wall. The projecting portion 59A is elongate and oriented in a direction parallel to the attachment portion 57 of the handle. The projecting portion 59A extends beyond the mounting portion 59B while being shorter in length (measured in the transverse direction of the rod) than the attachment portion 57 of the handle. Thus, the projecting portion in particular is arranged for inserting into the receptacle 58C of the handle so as to hold the release mechanism in the first locked position.

Figure 9:
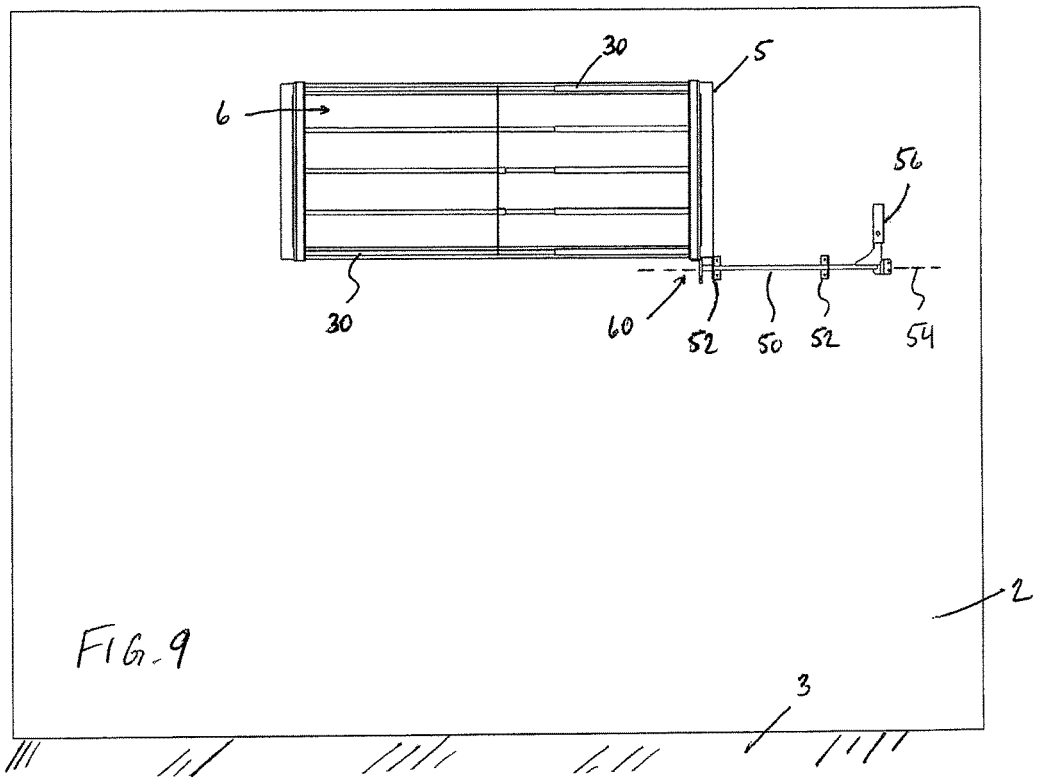
FIG. 9 is an inside elevation view similar to that of FIG. 2 of the apparatus of FIG. 1 but showing a connecting member mounted horizontally and the bar sections in the first obstructing position.
Figure 10:
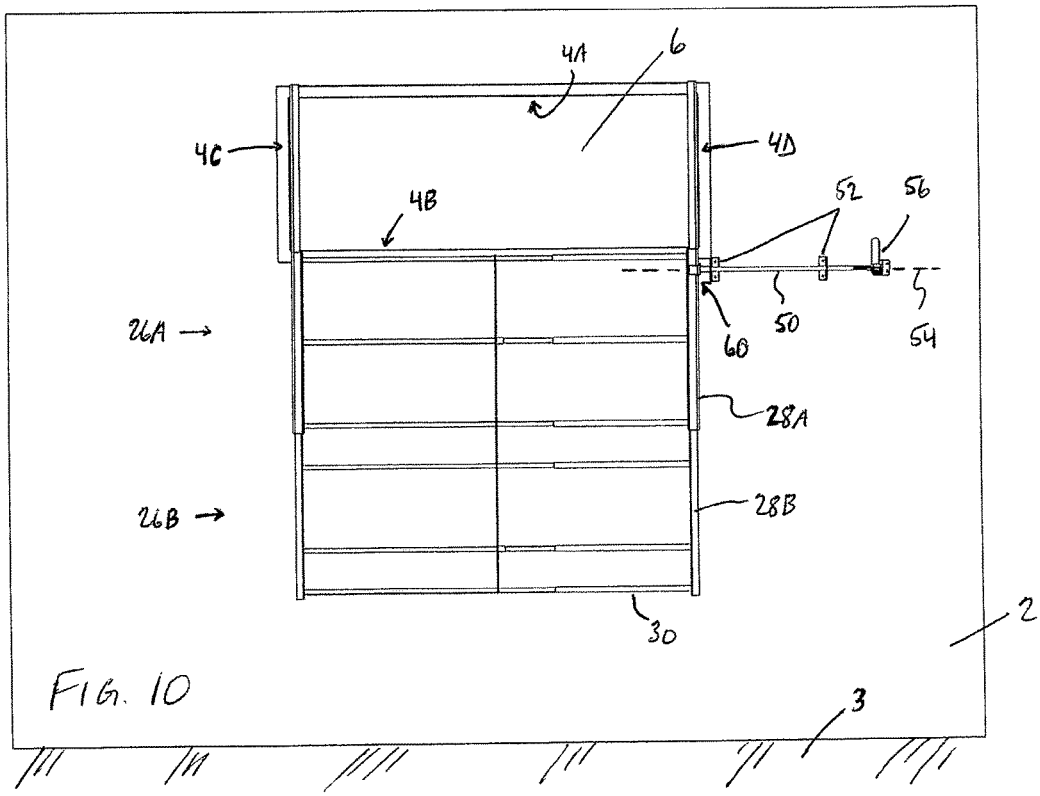
FIG. 10 is an inside elevation view like that in FIG. 9 of the bar sections in the second extended position and showing the connecting member mounted horizontally.

It will be appreciated that the mounting brackets 52 and projecting element 59 can be arranged on the wall so as to orient the rod 50 in a vertically upright orientation as shown in FIGS. 2 and 3, for example, or in a horizontal orientation as shown in FIGS. 9 and 10, for example. The pivotal movement effecting movement between the first locked and second unlocked positions is independent of the orientation of the rod. Furthermore, regardless of orientation, the mounting brackets locate the first end 50A of the rod at the window frame 5—more specifically, at an end of the sill 4B of the window frame—and the handle 46 spaced vertically below the sill as in the vertical orientation of the rod or the handle spaced horizontally along the wall away from the side jamb 4C of the window frame.

The release mechanism 48 includes an abutting portion 60 at the first end 50A of the rod. The abutting portion 60 comprises a larger first retaining plate 62 extending transversely from the rod 50. In the vertical orientation of the rod 50, the first retaining plate provides support for the bar sections 30 thereabove in the first obstructing position. The first retaining plate 62 is planar and comprises opposing side edges 62A and 62B, an outer end edge 62C, and an inner end edge 62D. The rod 50 is coupled to the first retaining plate 62 at a position thereon closer to the outer end edge 62C than the inner end edge 62D. The inner edge follows a bent or curved path between the side edges 62A and 62B such that a first one of the side edges 62A extends beyond a second one of the side edges 62B. The bent or curved path may reduce range of pivotal movement between the first locked and second unlocked positions when the rod 50 is oriented vertically. In the vertical orientation, a free end portion 64 of the first retaining plate 62 at the inner end edge is suited for positioning beneath the bar sections 26A, 26B in the first locked position so that the bar sections are retained thereabove. The free end portion 64 of the first retaining plate 62 is swung away from the bar sections towards the wall in the illustrated embodiment as shown between FIGS. 6 and 7 in the movement of the first retaining plate from the first locked position to the second unlocked position.

Figure 12:
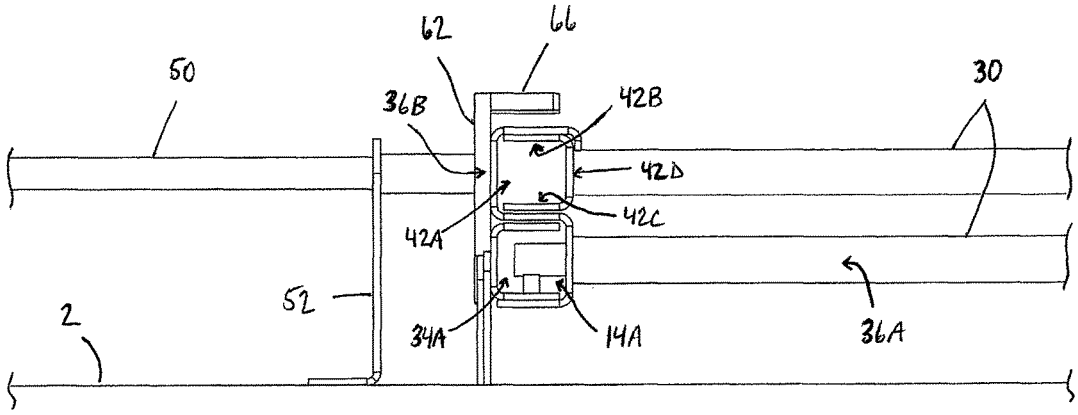
FIG. 12 is a top plan view of the release mechanism as shown in FIG. 10 freed from beneath the bar sections.

Further to the first retaining plate, the abutting portion 60 comprises a smaller second retaining plate 66 extending transversely to the larger first retaining plate 62 at the outer edge 62C thereof. In the horizontal orientation of the rod 50, the second retaining plate provides support for the bar sections 30 thereabove in the first obstructing position. The second retaining plate is spaced away from the axis 54 of the rod so as to be offset therefrom while being oriented parallel thereto. The second retaining plate 66 is generally rectangular in shape and oriented generally parallel to the axis of the rod 50. The second retaining plate extends from the first retaining plate 62 in a direction away from the rod so that second retaining plate is positionable beneath the bar sections 26A, 26B in the first locked position as better shown in FIG. 11. Then, the second retaining plate is swung outwardly away from the wall so as to move into the second unlocked position of the release mechanism as more clearly shown in FIG. 12. As such, the second retaining plate is located horizontally outwardly of the track member 28A or 28B of the corresponding main bar section 26A and the auxiliary bar section 26B in the second unlocked position so that the bar sections are slidably movable between the second retaining plate 66 which is in the second unlocked position and the wall 2. It will be appreciated that the second retaining plate may not be smaller in size than the first retaining plate in other embodiments.

For installation, typically openings in the side jambs 4C and 4D are drilled so as to receive the frame fastening elements 18 therein. Apertures in the mounting plates 16 are aligned with the respective openings in the side jambs 4C, 4D and the frame fastening elements are inserted through the apertures so as to fasten the mounting plates 16 to the window frame 5. The covering plates 22 are positioned flush over the mounting plates 16, and the main rails 12 are fastened by the rail fastening elements 24 to the mounting and covering plates at an interface between the base portions 14D of the main rails and the covering plates 22. The rail fastening elements 24 are inserted through respective apertures in the respective main rails 12 and corresponding apertures in the covering and mounting plates such that head ends of the rail fastening elements are at the base portion 14D of the respective main rail. As such, the rail fastening elements 24 are accessible through the respective channel openings 14A of the primary pair of channels 36A. Note that in the illustrated embodiment, the main bar section 26A is permanently mated with the main rails 12 such that the bar sections 26A, 26B are required to be in the second extended position in order to permit fastening of the main rails to the mounting and covering plates. Also, the bar members 30 of the bar sections 26A and 26B are adjusted in length so that the main rails and track members of each bar section fit a width of the window 1. In other embodiments, the main rails and main bar section are not permanently mated such that the main rails, free of the bar sections, are installed by fastening to the mounting and covering plates. Afterwards, the bar sections can be mated with the main rails. This mating may be effected by manoeuvering the guiding element 38 on each track member 28A into the respective guiding slot 40 of the respective main rail 12.

To uninstall the apparatus, the installation process is reversed.

In use, the bar sections are horizontally adjacent to one another so as to overlap one another in the first obstructing position. That is, the main rails 12 are fully slidably received in the primary pair of channels 36A of the main bar section 26A, and the auxiliary bar section 26B is fully slidably received in the secondary pair of channels 36B of the main track members 28A. Thus, each one of the bar sections 26A, 26B is spanning across the egress opening 6 so as to obstruct the opening in the first obstructing position. The staggered arrangement of the bar members 30 of the two bar sections, as better shown in FIG. 4, and the upright support members 46 of each bar section form a grate in the first obstructing position. The release mechanism 48 is positioned so that the abutting portion 60 is located beneath the bar sections 26A, 26B and the bar sections are resting on the abutting portion thereby being retained in the first obstructing position. In this manner, the security and escape apparatus is suited for resisting passage of a person such as an intruder through the egress opening 6, especially from the outside. The main rails 12 support the bar sections in sufficiently close proximity to the window frame 5 such that the vertical sliding movement of the bar sections is not impeded and so that the person cannot fit in between the head 4A or sill 4B and the bar sections 26A, 26B in the first obstructing position. Furthermore, the rail fastening elements 24 are inaccessible in that the track members 28A of the main bar section 26A are covering the rail fastening elements in the first obstructing position. Thus, it is difficult for the intruder to disassemble the main rails 12 from the mounting and covering plates 16 and 22 so as to enter through the egress opening 6.

Figure 5:
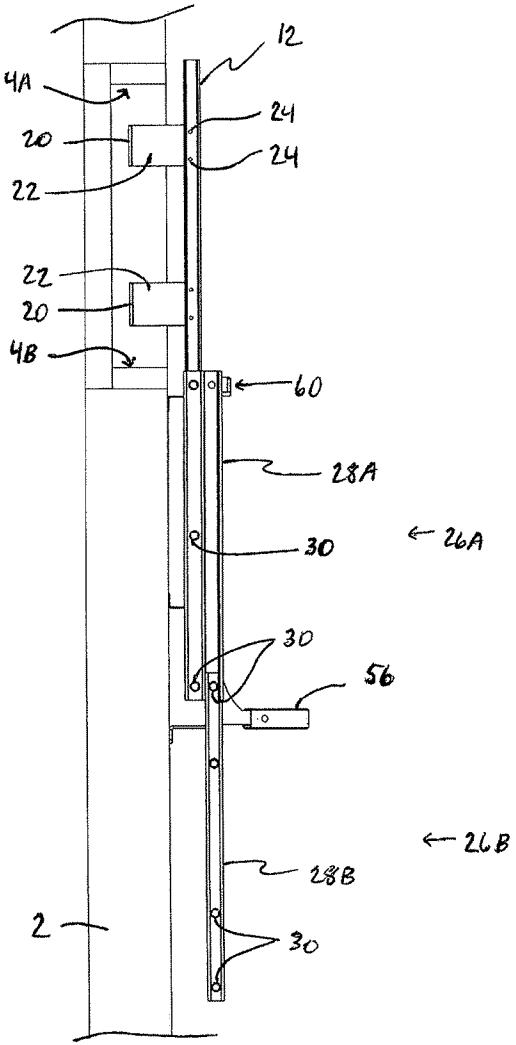
FIG. 5 is a cross-sectional view of the apparatus of FIG. 1 along line 5-5 illustrating the apparatus in the second extended position.

In an emergency necessitating exit through the egress opening 6, for example, the bar sections 26A, 26B are moved into the second extended position. In this extended position, the bar sections are positioned vertically adjacent to one another such that all of the bar members, except for the bottommost bar member of the main bar section 26A and the topmost bar member of the auxiliary bar section 26B, define individual ladder rungs of a ladder formed by the bar sections in the extended position. Furthermore, the bottommost bar member of the main bar section 26A and the topmost bar member of the auxiliary bar section 26B collectively define one common ladder rung of the ladder as better illustrated in FIGS. 3 and 5; in the illustrated embodiment, the overlapping bar members are aligned in a horizontal plane so that the common ladder rung is as comfortable to use for climbing as the remaining ladder rungs.

In other words, each bar section 26A, 26B defines a short ladder in the second extended position. Thus, the bar sections are disposed vertically side-by-side so that each bar section forms an extension or continuation in a vertical direction of the short ladder defined by another bar section.

In moving the bar sections to the second extended position, the release mechanism 48 is moved into the second unlocked position so that the abutting portion 60 is moved away from beneath the bar sections, regardless of horizontal or vertical orientation of the rod 50, thereby allowing the bar sections to slide vertically downward by gravity. The projecting guide element 38 retains the main bar section 26A on the main rails 12. In the second extended position, the egress opening 6 is unobstructed and the apparatus can be used to exit through the egress opening, typically by climbing out of same.

In case of accidental deployment, for example, the bar sections may be moved back to the first obstructing position from the second extended position by raising the bar sections 26A, 26B. The bar sections are held in place, in the first obstructing position, while the release mechanism 48 is moved into the first locked position so as to maintain the bar sections in the first obstructing position.

Note that in alternative embodiments, the frame fastening elements 18 may protrude from the outer face 17B (especially the head ends 18A of the frame fastening elements). Consequently, the covering plate 22 may comprise recessed areas on its inner face sized and shaped to receive the heads ends 18A of the frame fastening elements therein when the covering plate 22 and mounting plate 16 are installed in butting engagement with one another.

In further alternative embodiments, the abutting portion 60 may only comprise one of the first retaining plate 62 and the second retaining plate 66 according to an intended mounting orientation of the release mechanism.

In another arrangement 10' as more clearly shown in FIGS. 15 to 23, the connecting rod 50 is disposed generally horizontally across the window 1 and in front of same so as to span between the side jambs 4C, 4D. In this arrangement, the connecting rod 50 is carried by the mounting plates 16 on either side of the apparatus 10' that include apertures aligned axially of the connecting member, that is along the connecting rod's axis 54, so that this member passes therethrough. The connecting rod is thus located intermediate the first bar section 26A and the window 1.

There are provided a pair of retaining elements 101A and 101B at spaced positions along the connecting member 50 such that each retaining element is located on either side of a central plane P of the bar sections at a substantially equal distance from the central plane. The retaining elements 101A, 101B are affixed to the connecting member 50 so as to be held in fixed relation to the connecting member and thus move therewith. The retaining elements are therefore disposed at a central location intermediate the track members 28A, 28B of the bar sections 26 and 26B such that the bar sections are supported by the retaining elements inwardly of the track members in the first locked position of the release mechanism.

The retaining elements 101A, 101B may be formed from plates extending radially of the connecting rod that are thus formed into hooks in the illustrated arrangement with 103 tips located beyond the bars 30 of the second bar section 26B in the first locked position. In other arrangements, tips of the retaining elements may be located at the bars, that is at a bottommost surface of the bars just so that the respective bar may rest on the retaining element. The retaining elements are shaped so as to cup both bar sections in the first locked position of the release mechanism when the bar sections are rested on same. Furthermore, in the illustrated arrangement the hooks engage the bottommost bars of the respective bar section in the first locked position of the release mechanism and the first obstructing position of the bar sections.

The connecting rod includes a receptacle 104 at its second end 50B that is open in a direction along the axis 54 of the rod and away from the main rails 12. The receptacle extends radially of this axis 54 to an axially-offset position and is thus oblong, for example oval, in shape at its opening.

The handle 56, which is not affixed to the connecting member in this arrangement, cooperates with the connecting member via a projecting member 106 which is movable along an axis A parallel to but offset from the axis 54 of the connecting rod. A conventional linkage 107 is used to translate movement of this projecting member 106 along its axis A to a rotational movement of the handle about another axis H. The axis of the projecting member 106 defines a control axis along which movement of the projecting member controls pivotal movement of the connecting member 50.

The handle 56, projecting member 106, and conventional linkage 107 are supported on the wall 1 by a bracket body 108 attached fixedly to the wall. The bracket body 108 includes a plurality of flanges 108A and 108B projecting transversely to the wall and spaced horizontally from one another. These flanges 108A, 108B carry apertures which are coaxial with the control axis H such that the projecting member 106 passes through and moves along a channel formed by these apertures that lies along the control axis H. The apertures are presented at a location spaced further from the wall than the connecting member 50 so as to offset the control axis H from the axis 54 of the connecting member. Additionally, the bracket body 108 includes another pair of vertically spaced apart flanges 108C and 108D between which the conventional linkage moves when operated by the handle 56.

In use of this second illustrated arrangement, the bar sections 26A and 26B are held up in their first obstructing position by the retaining elements 101A, 101B which are thus positioned horizontally beneath the bar sections in the first locked position. In the first locked position, the bar sections 26A and 26B are thus resting by their weight on the retaining elements 101A, 101B, and the projecting member 106 is inserted in the receptacle 104 at its position offset from the connecting rod's axis 54 thus preventing the connecting member 50 from rotating thereabout.

Then, to deploy the apparatus 10' into the second extended position forming the ladder, the handle is operated so as move the projecting member 106 along the control axis A out from inside the receptacle 104. The connecting member 50 is then free to rotate about its axis such that the weight of the bar sections pushes the retaining elements 101A and 101B out from underneath same.

The second illustrated arrangement also includes a pair of feet 109A and 109B connected to the second bar section 26B which engage the floor surface 3 in the second extended position for additional support when a user climbs the ladder formed by the apparatus in this position. The feet 109A, 109B are substantially planar including an attachment portion 110 where the feet are carried by bars 30 of the respective bar section passing through openings 111 in the plates forming the feet, and a base portion 112 including a flange 114 extending transversely from a plane of the attachment portion towards the central plane P. The flange 114 comprises a pair of individual flange pieces with one extending from a rear peripheral edge of the base portion opposite the wall surface and another one extending from a bottom peripheral edge of the base portion opposite the floor support surface 3. The flange 114 thus provides a larger surface area for resting on the support surface 3 beneath the window 1.

Figure 21:
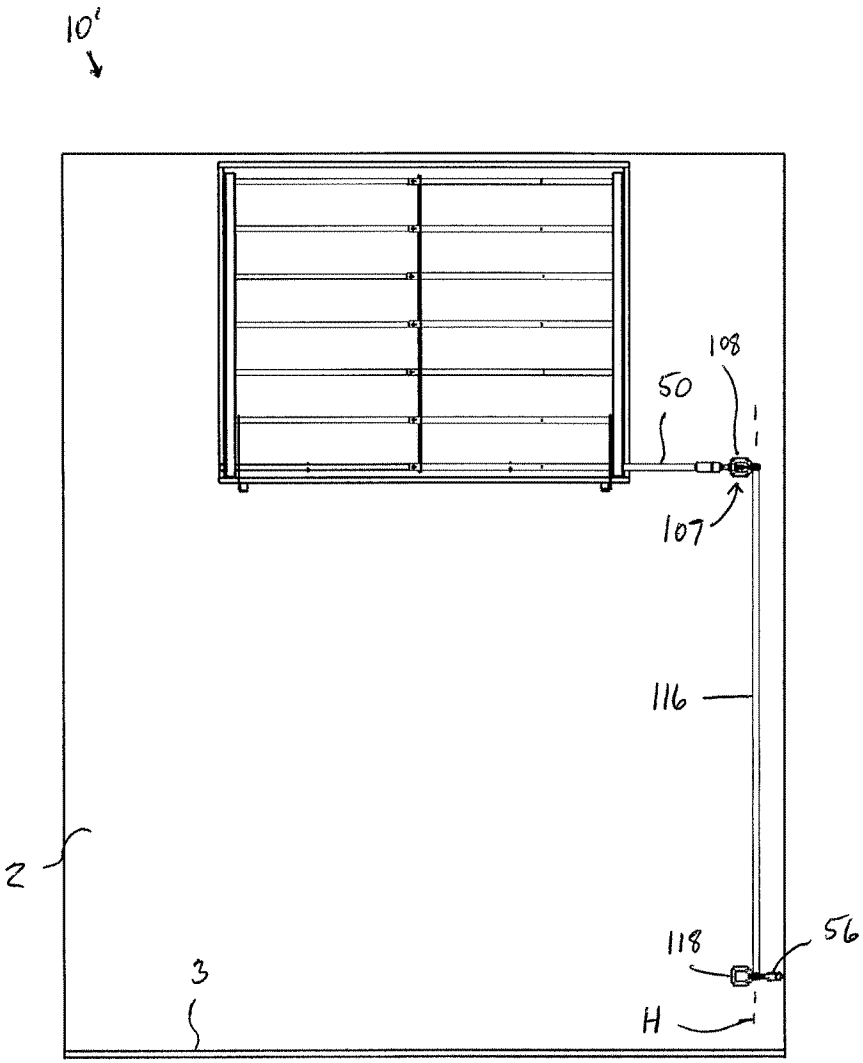
FIG. 21 is an inside elevational view of the arrangement of FIG. 15 but including additional components to present a handle at a location spaced below the window.
Figure 22:
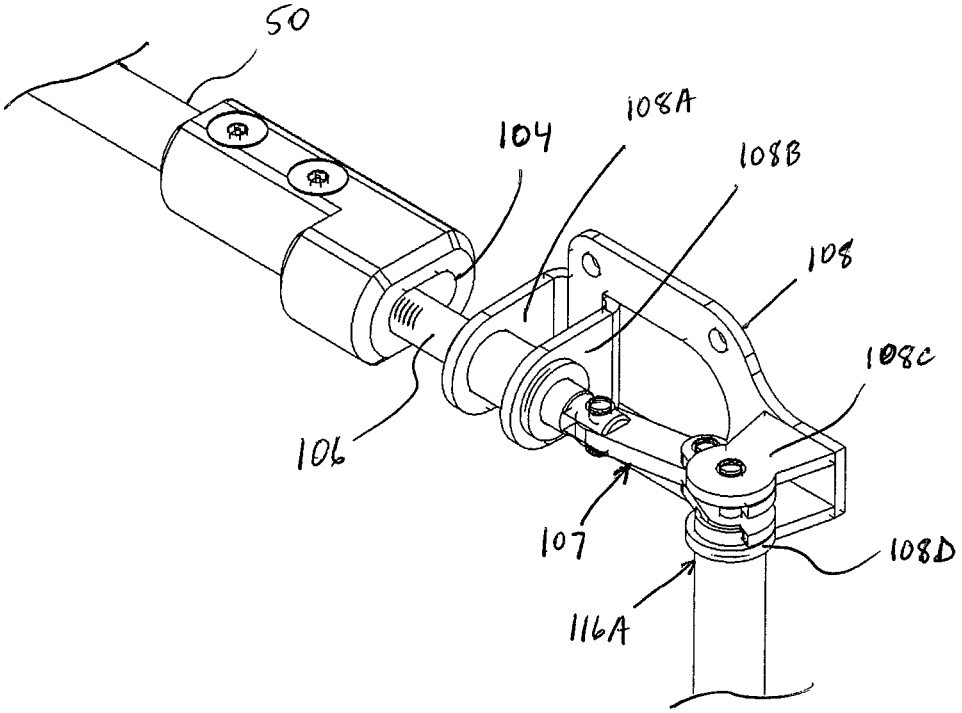
FIG. 22 is a perspective view of upper and lower ends of a portion of the arrangement of FIG. 21 to one side of the window where the arrangement is in a first obstructing position and a release mechanism is in a first locked position.
Figure 22:
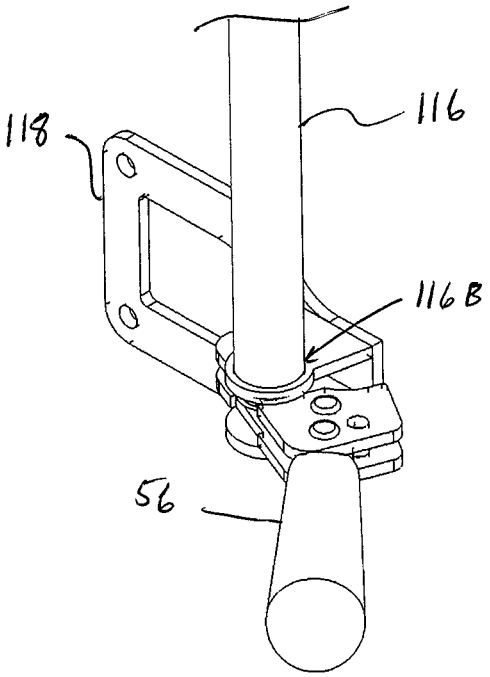
Figure 23:
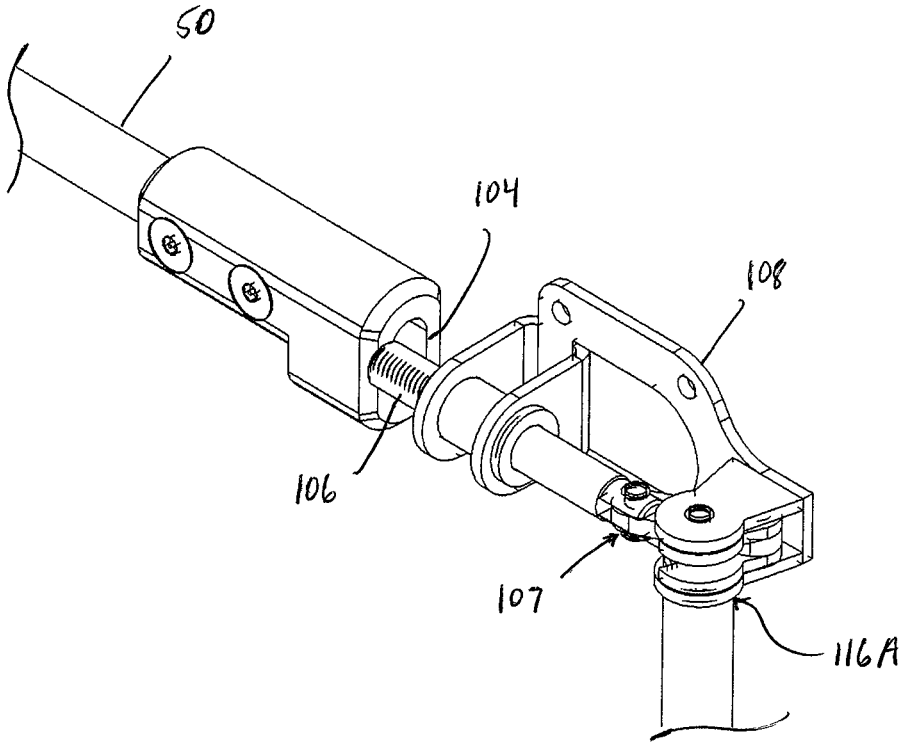
FIG. 23 is a perspective view of the arrangement of FIG. 21 of upper and lower ends of a portion of the arrangement of FIG. 21 to one side of the window where the arrangement is in a second extended position and the release mechanism is in a second unlocked position.
Figure 23:
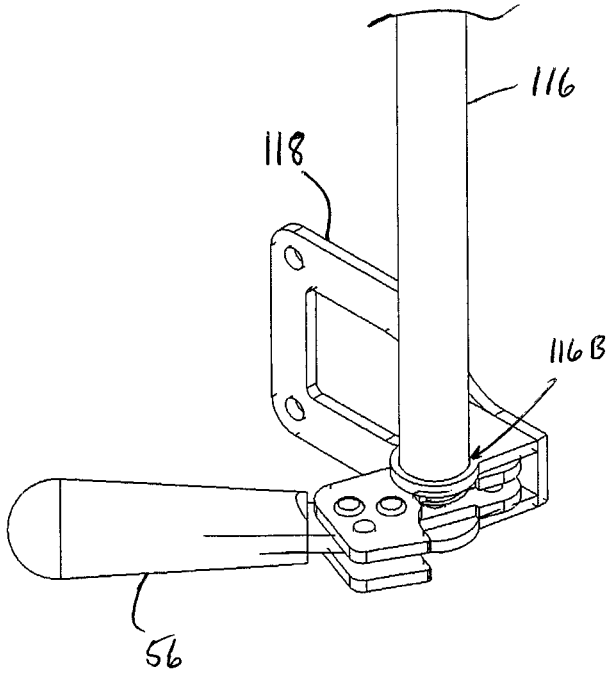

Similarly to the first illustrated arrangement more clearly shown in FIGS. 1 to 14, the apparatus 10' in the second arrangement may be arranged to present the handle 56 at a position spaced below the window 1 as is more clearly shown in FIG. 21. This arrangement includes an elongate extension member 116 forming a rod operatively coupled at its upper end 116A to the conventional linkage 107, which is in turn connected to the projecting element 106. The handle 56 is thus located at a lower end 116B of the extension member which is closer to the support surface 3 than the connecting member 50, with which the handle is generally horizontally aligned in the previous setup of the second arrangement that is more clearly shown in FIGS. 15 and 17 to 19. Therefore, the extension member 116 lies along the axis H about which the handle 56 is rotated for operating the projecting element 106 and acts as a spacer or spacing member between the conventional linkage 107 and the handle 56 allowing the handle to be located at a distance therefrom. The upper end 116A of the extension member is supported at the bracket body 108 and the lower end 116B is carried at a separate bracket body 118 attached fixedly to the wall with flanges similar to those indicated at 108C and 108D. Separate housings may be provided at the upper and lower ends 116A, 116B of the extension member for covering the components thereat such that children may be protected from harm from the components at these particular locations.

Figure 20:
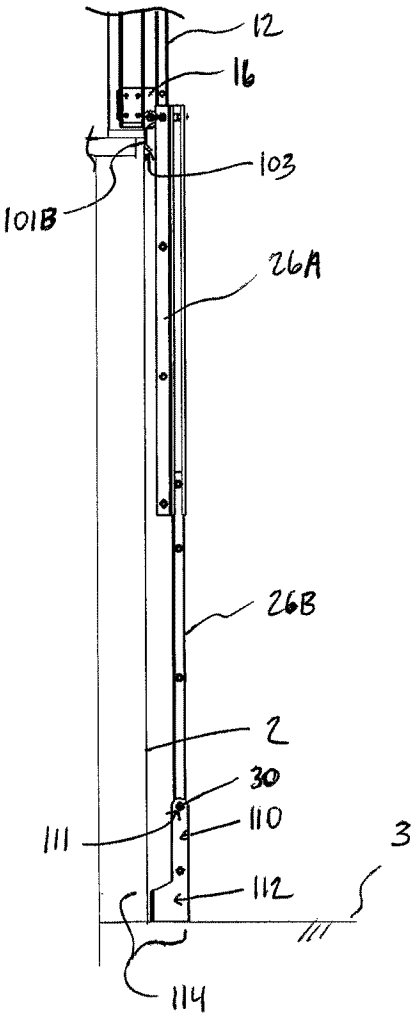
FIG. 20 is a cross-sectional view along line 20-20 in FIG. 19.

Furthermore, as shown in FIG. 20, it will be appreciated that the connecting member 50 may have a length so as to present its free second end 50B spaced further horizontally outwardly along the wall from the window 1.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A security and escape apparatus in combination with a window mounted in a wall;

the window comprising:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus comprising:

a first bar section and a second bar section each comprising a pair of upright track members spaced apart from one another and a plurality of bar members extending transversely between the pair of track members at longitudinally spaced positions along the track members;

a pair of main rails oriented upright and respectively mounted to each side jamb thereby locating the main rails horizontally outward of the window frame and away from the wall;

the track members of the first bar section being mated to the main rails such that the first bar section is vertically slidable relative to the main rails in a longitudinal direction;

the first and second bar sections being movable relative to the window frame in vertical sliding movement between a first obstructing position in which at least the first bar section is obstructing the egress opening and a second extended position in which each of the first and second bar sections is disposed below the egress opening so that the bar members define ladder rungs usable for exiting through the egress opening unobstructed by each of the first and second bar sections;

wherein the second bar section is mated to the first bar section such that the second bar section is vertically slidable relative to the first bar section;

wherein each track member of the first bar section comprises a pair of upright channels which are disposed horizontally side-by-side, a first one of the channels slidably receiving one of the main rails therein and a second one of the channels slidably receiving one of the track members of the second bar section therein such that at least one bar member of the first bar section and at least one bar member of the second bar section are equal in length between the track members of a respective one of the first and second bar sections.

2. The security and escape apparatus according to claim 1 wherein each channel is generally U-shaped in cross-section.

3. The security and escape apparatus according to claim 2 wherein each channel comprises a longitudinal channel opening, the channel openings of the first and second channels facing in opposing directions along the wall which are transverse to the longitudinal direction.

4. The security and escape apparatus according to claim 3 wherein the channel opening of the first channel of the respective track member is facing a first direction which is transverse to a direction extending outwardly away from the window frame, the first direction configured to be parallel with respect to a major plane of the wall, and the channel opening of the second channel is facing in an opposite and parallel direction with respect to the first direction and faces towards the second channel of an opposite one of the track members of the first bar section.

5. The security and escape apparatus according to claim 1 wherein each track member of the first bar section is generally S-shaped in cross-section such that each upright channel is generally U-shaped in cross-section.

6. The security and escape apparatus according to claim 1 wherein the lengths of the bar members of the first and second bar sections are adjustable such that lateral spacing between the main rails is adjustable for fitting the window frame.

7. The security and escape apparatus according to claim 1 wherein intermediate ones of the bar members of each of the first and second bar sections which are located between a top one of the bar members and a bottom one of the bar members of the respective one of the first and second bar sections are staggered relative to the intermediate ones of the bar members of the other one of the first and second bar sections thereby forming a grate in the first obstructing position when both the first and second bar sections are obstructing the egress opening.

8. A security and escape apparatus in combination with a window mounted in a wall;

the window comprising:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus comprising:

at least one bar section comprising a first bar section, each of the at least one bar section including a pair of upright track members spaced apart from one another and a plurality of bar members extending transversely between the pair of track members at longitudinally spaced positions along the track members;

a pair of main rails oriented upright and respectively mounted to each side jamb thereby locating the main rails horizontally outward of the window frame and away from the wall;

the track members of the first bar section being mated to the main rails such that the first bar section is vertically slidable relative to the main rails in a longitudinal direction;

the at least one bar section being movable relative to the window frame in vertical sliding movement between a first obstructing position in which at least the first bar section is obstructing the egress opening and a second extended position in which each of the at least one bar section is disposed below the egress opening so that the bar members define ladder rungs usable for exiting through the egress opening unobstructed by each bar section;

a release mechanism operatively coupled to the at least one bar section such that the release mechanism is movable between a first locked position in which the release mechanism retains the at least one bar section in the first obstructing position and a second unlocked position in which the release mechanism frees the at least one bar section for moving into the second extended position;

the release mechanism comprising:

an elongate connecting member having a first end at or adjacent the sill of the window and an opposing second end at a distance spaced away from the window frame;

a mounting arrangement supporting the connecting member at the wall;

an abutting portion at or adjacent the first end of the connecting member;

a handle spaced from the first end of the connecting member for moving the release mechanism between the first locked position and the second unlocked position;

wherein the abutting portion is positioned beneath the at least one bar section in the first locked position to retain the at least one bar section in the first obstructing position above the abutting portion;

wherein the abutting portion is positioned horizontally outward of the at least one bar section in the second unlocked position such that the at least one bar section is free of the abutting portion and the vertical sliding movement of the at least one bar section is unobstructed by the abutting portion.

9. The security and escape apparatus according to claim 8 wherein the release mechanism is movable between the first locked and second unlocked positions by pivotal movement of the connecting member about an axis defined by said connecting member.

10. The security and escape apparatus according to claim 8 wherein the abutting portion comprises a retaining element movable between the first locked and second unlocked positions by pivotal movement about an axis defined by the connecting member.

11. The security and escape apparatus according to claim 8 wherein the at least one bar section additionally comprises a second bar section and the abutting portion is positioned beneath each of the first and second bar sections in the first locked position.

12. The security and escape apparatus according to claim 8 wherein the connecting member is oriented substantially horizontally such that the handle of the release mechanism is spaced along the wall in a direction transverse to a major length of a proximal one of the side jambs of the window.

13. The security and escape apparatus according to claim 12 wherein the abutting portion comprises at least one retaining element disposed at a central location intermediate the track members of the at least one bar section when in the first locked position such that the at least one bar section is supported by said at least one retaining element inwardly of the track members in the first locked position.

14. The security and escape apparatus according to claim 12 wherein the release mechanism is movable between the first locked and second unlocked positions by pivotal movement of the connecting member about an axis defined by said connecting member and the handle is operatively coupled to a projecting element which is movable relative to the connecting member so that the projecting element cooperates with a receptacle in the connecting member to control movement from the first locked position to the second unlocked position.

15. The security and escape apparatus according to claim 14 wherein the projecting element is pivotally movable about a control axis which is parallel to but offset from the axis of the connecting member.

16. A security and escape apparatus in combination with a window mounted in a wall;

the window comprising:

a head at a top of the window;

a sill at a bottom of the window;

side jambs at opposing sides of the window spanning between the sill and the head;

an egress opening delimited by a window frame which is collectively defined by the sill, head, and side jambs;

the security and escape apparatus comprising:

at least one bar section comprising a first bar section, each of the at least one bar section including a pair of upright track members spaced apart from one another and a plurality of bar members extending transversely between the pair of track members at longitudinally spaced positions along the track members;

a pair of main rails oriented upright and respectively mounted to each side jamb thereby locating the main rails horizontally outward of the window frame and away from the wall;

the track members of the first bar section being mated to the main rails such that the first bar section is vertically slidable relative to the main rails in a longitudinal direction;

the at least one bar section being movable relative to the window frame in vertical sliding movement between a first obstructing position in which at least the first bar section is obstructing the egress opening and a second extended position in which each of the at least one bar section is disposed below the egress opening so that the bar members define ladder rungs usable for exiting through the egress opening unobstructed by each bar section;

each main rail being supported by at least one mounting plate fastened by frame fastening elements to a respective one of the side jambs, the at least one mounting plate having an inner face facing at the respective one of the side jambs and an opposite outer face at which the frame fastening elements are accessible;

and a covering plate received in butting engagement with the outer face of the at least one mounting plate to conceal the frame fastening elements;

wherein the covering plate is fastened to a respective one of the main rails in sandwiched relation between the at least one mounting plate and the respective one of the main rails.

17. The security and escape apparatus according to claim 16 wherein each main rail comprises an upright channel oriented in the longitudinal direction that slidably receives a respective one of the track members of the first bar section, the channel being generally U-shaped in cross-section and having a longitudinal channel opening and a base portion directly opposite thereto, and the at least one mounting plate and the covering plate being fastened by rail fastening elements to the base portion of the channel where the rail fastening elements are accessible so that the rail fastening elements are concealed in the first obstructing position.

18. The security and escape apparatus according to claim 16 wherein the at least one mounting plate further comprises a hooked portion at a position opposite the respective one of the main rails, the hooked portion being curved outwardly from the respective one of the side jambs to a free hooked end which is at a position spaced from the outer face to accommodate the covering plate on the at least one mounting plate.

19. The security and escape apparatus according to claim 18 wherein the hooked portion extends across an edge of the covering plate which is adjacent the hooked portion so that the hooked portion is overlapping the covering plate.

* * * * *